US009950776B2

(12) United States Patent
Sacker et al.

(10) Patent No.: US 9,950,776 B2
(45) Date of Patent: Apr. 24, 2018

(54) WEED-TRIMMER OUTBOARD MOTOR

(71) Applicants: John Raymond Sacker, Ira, MI (US); Denis R. Dompierre, Applegate, MI (US)

(72) Inventors: John Raymond Sacker, Ira, MI (US); Denis R. Dompierre, Applegate, MI (US)

(73) Assignee: Aqua Marine Products, L.L.C., Warren, MI (US)

( * ) Notice: Subject to any disclaimer, the term of this patent is extended or adjusted under 35 U.S.C. 154(b) by 461 days.

(21) Appl. No.: 14/121,821

(22) Filed: Oct. 21, 2014

(65) Prior Publication Data

US 2015/0111447 A1 Apr. 23, 2015

Related U.S. Application Data

(60) Provisional application No. 61/995,439, filed on Apr. 9, 2014, provisional application No. 61/961,735, filed on Oct. 22, 2013.

(51) Int. Cl.

| | |
|---|---|
| ***B63H 20/14*** | (2006.01) |
| ***B63H 20/06*** | (2006.01) |
| ***B63H 23/06*** | (2006.01) |
| *B63H 20/00* | (2006.01) |
| *B63H 20/32* | (2006.01) |

(52) U.S. Cl.

CPC ..... *B63H 20/06* (2013.01); *B63H 20/14* (2013.01); *B63H 23/06* (2013.01); *B63H 20/007* (2013.01); *B63H 2020/323* (2013.01)

(58) Field of Classification Search

CPC ..... B63H 20/00; B63H 20/14; B63H 20/007

See application file for complete search history.

(56) References Cited

U.S. PATENT DOCUMENTS

| | | | | |
|---|---|---|---|---|
| 4,179,805 | A | 12/1979 | Yamada | 30/122 |
| 4,505,040 | A | 3/1985 | Everts | 30/296 R |
| 4,604,067 | A | 8/1986 | Roberts | 440/49 |
| 4,752,256 | A | 6/1988 | Dorion | 440/49 |
| 4,976,637 | A | 12/1990 | Newell et al. | 440/49 |

(Continued)

OTHER PUBLICATIONS

MAN Diesel & Turbo, "Basic Principles of Ship Propulsion", Dec. 2011. Retrieved from https://marine.man.eu/docs/librariesprovider6/propeller-aftship/basic-principles-of-propulsion.pdf?sfvrsn=0 on Nov. 3, 2017 (Year: 2011).*

(Continued)

*Primary Examiner* — Andrew Polay

(74) *Attorney, Agent, or Firm* — Christopher John Rudy

(57) ABSTRACT

Weed-trimmer outboard motor attachment has a lower shaft housing with a proximal coupling to correspondingly mate and engage a distal mid-shaft coupling of an upper part of a motorized weed-trimming device having a motor and a shaft that rotate a number of rotations per minute when operating; a distal termination thereto, which includes a propeller; and a rotation speed reduction unit to reduce a number of rotations of the propeller in relation to the number of rotations of the motor of the motorized weed-trimming device. The attachment can be assembled with the weed-trimming device to provide an outboard motor. A mount for mounting the weed-trimmer outboard motor to a boat can be provided as well.

20 Claims, 30 Drawing Sheets

(56) References Cited

U.S. PATENT DOCUMENTS

| | | | | |
|---|---|---|---|---|
| 5,083,948 | A | 1/1992 | Grobson | 440/49 |
| 5,312,277 | A * | 5/1994 | Selmer | B63H 23/26 192/3.31 |
| 5,405,277 | A | 4/1995 | Stalker | 440/49 |
| 6,616,489 | B1 * | 9/2003 | Dompierre | A01D 34/416 440/49 |
| 2004/0092176 | A1 * | 5/2004 | Allen | B63B 35/7943 440/49 |
| 2012/0065942 | A1 * | 3/2012 | Hwang | G06F 17/5095 703/1 |

OTHER PUBLICATIONS

Volvo Penta, "Propellers, Inboard propellers and speed calculation Marine Engines 2.1L-16L", Sep. 1998. Retrieved from http://www.akcaymarin.com/Products/%C3%B6zelklavuzlar/Volvo%20Penta%20prevane%20klavuzu.pdf Nov. 3, 2017 (Year: 1998).*

* cited by examiner

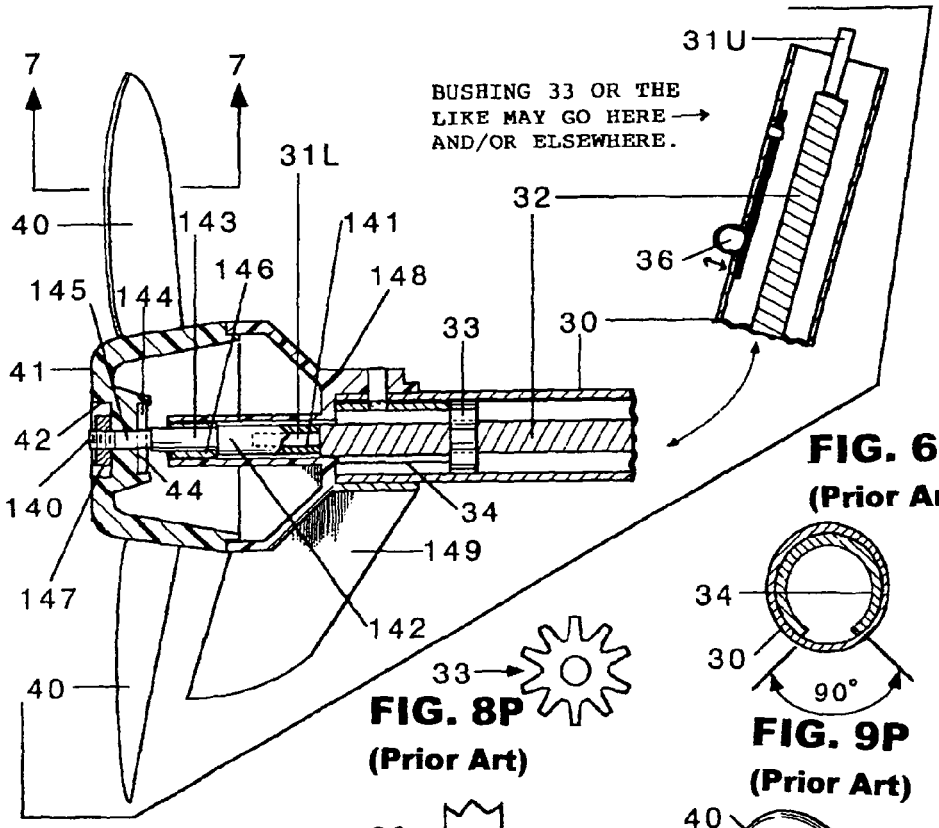
FIG. 6P
(Prior Art)
FIG. 9P
(Prior Art)
FIG. 8P
(Prior Art)
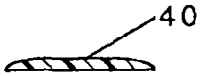
FIG. 7P
(Prior Art)
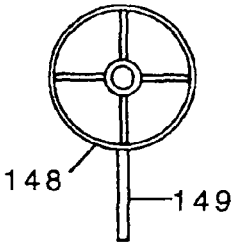
FIG. 10P
(Prior Art)
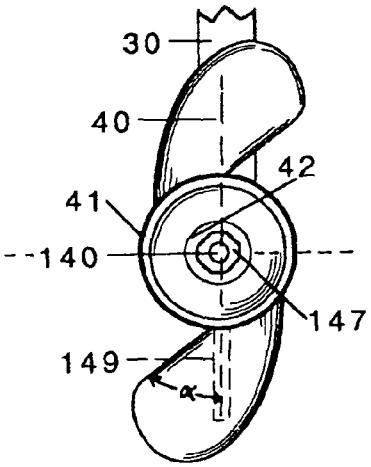
FIG. 11P
(Prior Art)
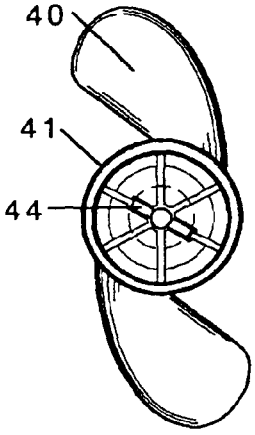
FIG. 12P
(Prior Art)

WEED-TRIMMER OUTBOARD MOTOR

This claims foreign priority benefits under 35 USC 119(a) of Canadian patent application No. 2,852,528 filed on May 16, 2014 A.D, and domestic priority benefits under 35 USC 119(e) of U.S. provisional patent application Nos. 61/961,735 filed on Oct. 22, 2013 A.D. and 61/995,439 filed on Apr. 9, 2014 A.D. The specifications of those applications, to include drawings, are incorporated herein by reference.

FIELD OF THE INVENTION

This concerns an attachment for a motorized weed-trimmer, which converts the trimmer into an outboard motor. It also concerns the converted trimmer and its use.

BACKGROUND TO THE INVENTION

Dompierre et al., U.S. Pat. No. 6,616,489 B1, discloses a weed-trimmer adapted with a screw or water wheel. See also, U.S. Pat. Nos. 4,179,805; 4,505,040; 4,604,067; 4,752,256; 4,976,637; 5,083,948 and 5,405,277—over all of which, the Dompierre et al. issued patent claims distinguished. The Dompierre et al. invention includes a lower shaft housing with a proximal coupling to correspondingly mate and engage a distal mid-shaft coupling of an upper part of a motorized weed-trimming device, and a distal termination, say, a propeller, thereto. It significantly increases the versatility of many weed-trimmers and provides many benefits for homeowners and captains of small vessels.

As good as it is, however, the Dompierre et al. invention is not without any drawback. For instance, it could cause premature burning out of a weed-trimmer motor. Also, a mount it can employ can include a swivel that may not always hold the assembly to the boat without attention of the operator.

It would be desirable to ameliorate if not solve the foregoing problems. It would be desirable to provide a weed-trimmer outboard motor adaptor and assembly with improved performance. It would be desirable to provide the art with an alternative.

A FULL DISCLOSURE OF THE INVENTION

In address of the above is provided a weed-trimmer outboard motor attachment comprising a lower shaft housing with a proximal coupling to correspondingly mate and engage a distal mid-shaft coupling of an upper part of a motorized weed-trimming device having a motor and a shaft that rotate a number of rotations per minute when operating; a distal termination thereto, which includes a propeller; and a rotation speed reduction unit to reduce a number of rotations of the propeller in relation to the number of rotations of the motor of the motorized weed-trimming device. The attachment can be assembled with the weed-trimming device to provide an outboard motor. A mount for mounting the weed-trimmer outboard motor to a boat can be provided as well.

The invention is useful in tool use and diversification, and in propulsion in water.

Significantly, by the invention, the art is advanced in kind. Premature burning out of a weed-trimmer motor is ameliorated if not solved. And, the art is provided with an alternative. The weed-trimmer outboard motor adaptor and assembly provide for improved performance in the water. The present mount for mounting the weed-trimmer outboard motor effectively holds the weed-trimmer outboard motor it to a boat yet allows for ready operation. The invention is economically efficient, practical, and fun to use. It also can have an easy to mount and operate throttle control. The invention receives notable praise. It may be considered an improvement over the Dompierre et al. patent.

Numerous further advantages attend the invention.

U.S. Pat. No. 6,616,489 B1 to Dompierre et al. is incorporated herein by reference in its entirety. This includes its drawings.

The drawings form part of the specification hereof. With respect to the drawings, which are not necessarily drawn to scale, the following is briefly noted:

FIGS. 1P-17P depict prior art from Dompierre et al., U.S. Pat. No. 6,616,489 B1:

FIG. 1P is a perspective view of the prior art motorized weed-trimmer device adapted to contain a screw or water-wheel. As the illustration whereof, the motorized device is embodied as a breakdown string weed-trimmer adapted to contain as the screw, here, a propeller. Thus, it can function as an outboard motor.

FIG. 6P is a side view, in partial cross-section, of a propeller-containing attachment of the invention of the prior art Dompierre et al., U.S. Pat. No. 6,616,489 B1.

FIG. 7P is a cross-sectional view of the propeller found within the attachment of FIG. 6P, taken along 7-7 of FIG. 6P.

FIG. 8P is an axial view of a cable centering bushing found within the attachment of FIG. 6P.

FIG. 9P is an axial view, in cross-section, of a lower tube with inner stop spring found within the attachment of FIG. 6P.

FIG. 10P is a rear view of a keel found within the attachment of FIG. 6P.

FIG. 11P is a rear view of the attachment of FIG. 6P.

FIG. 12P is a front view of the propeller found within the attachment of FIG. 6P, i.e., looking from the inside to the out.

Figure 1P:
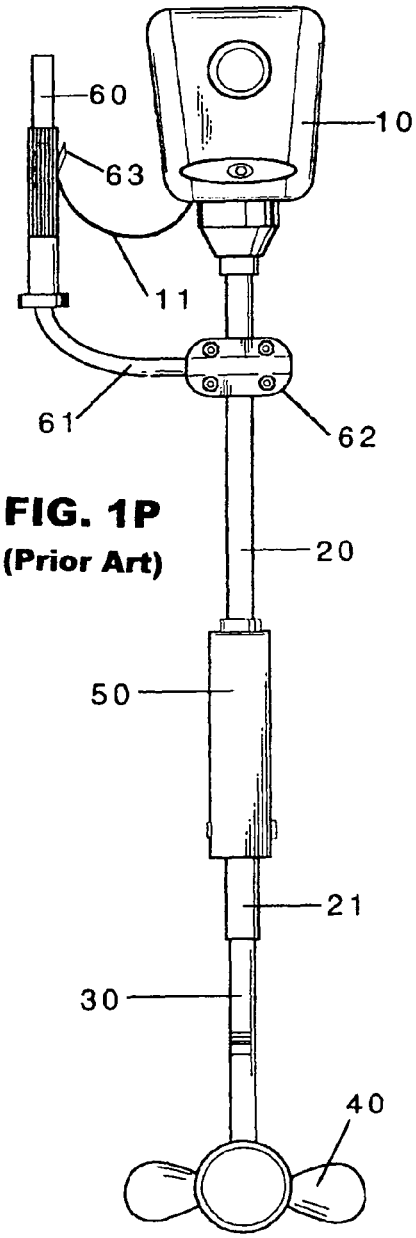
FIG. 1P (Prior Art)
Figure 2P:
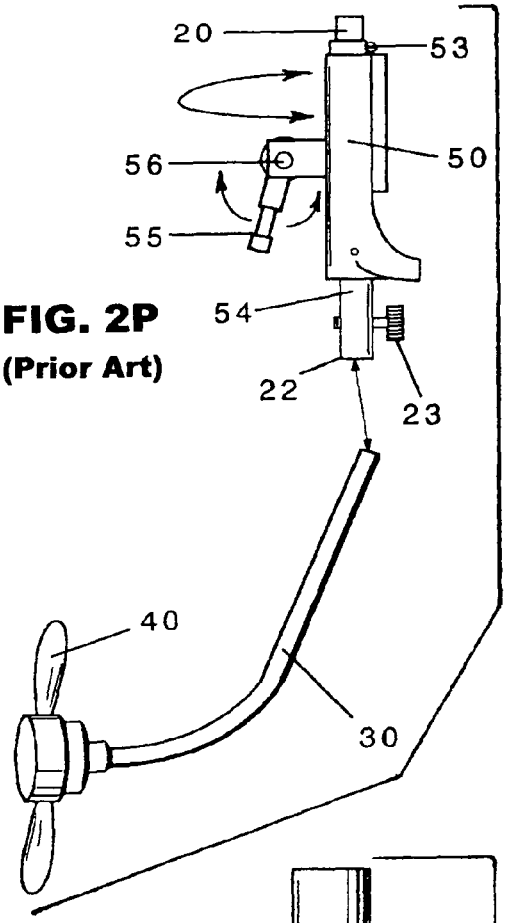
FIG. 2P (Prior Art)
FIG. 2P is an exploded side view of the lower drive assembly of the device of FIG. 1P. Also particularly illustrated thereby is a swivel mount adapter for mounting the invention to a boat.
Figure 3P:
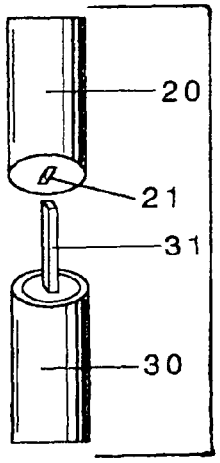
FIG. 3P (Prior Art)
FIG. 3P is an exploded perspective view of the lower drive assembly of the device of FIG. 1P. Particularly illustrated thereby is an exemplary drive coupling assembly.
Figure 4P:
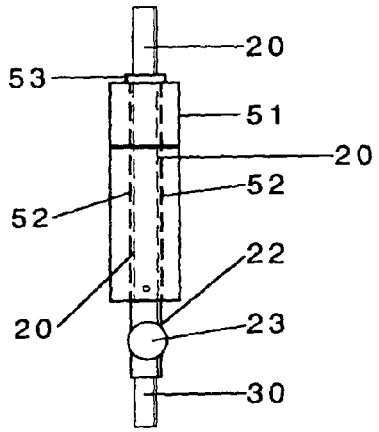
FIG. 4P (Prior Art)
FIG. 4P is a front view of the device of FIG. 1P, focusing upon the swivel mount adapter unit.
Figure 5P:
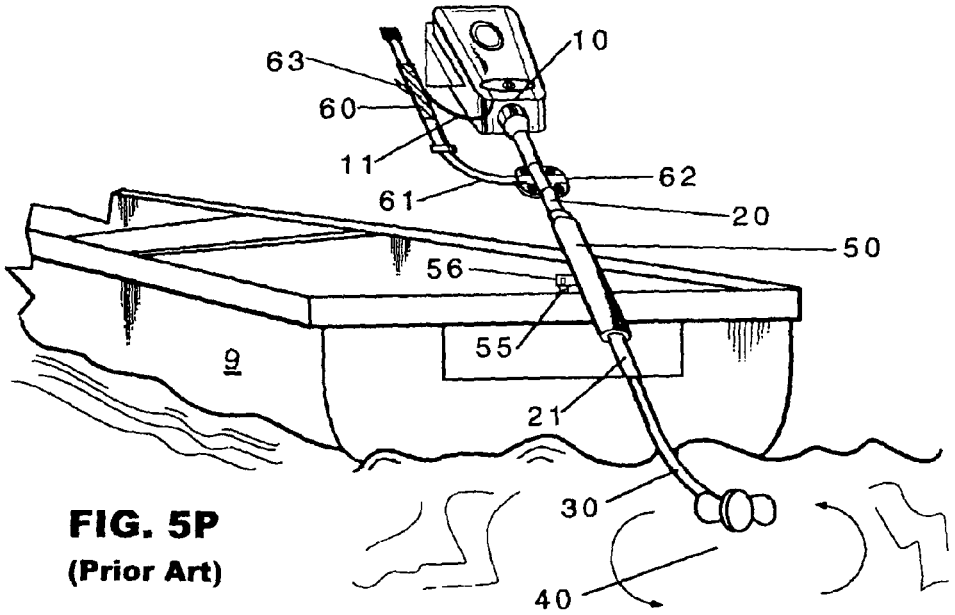
FIG. 5P (Prior Art)
FIG. 5P is a perspective view of the device of FIG. 1P mounted on a small boat.
Figure 13P:
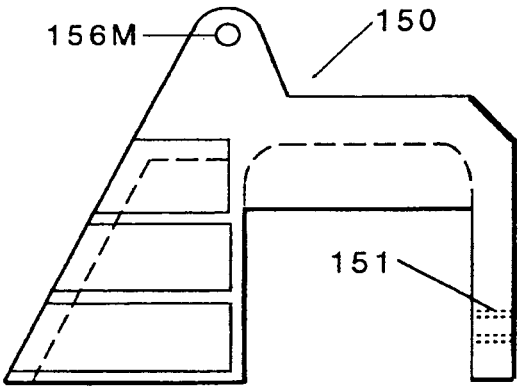
FIG. 13P (Prior Art)

FIG. 13P is a side plan view of a transom mount main body of the invention of the prior art Dompierre et al., U.S. Pat. No. 6,616,489 B1.

Figure 14P:
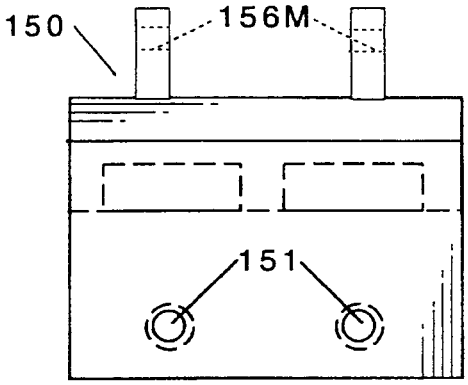
FIG. 14P (Prior Art)

FIG. 14P is a rear plan view of the body of FIG. 13P.

Figure 15P:
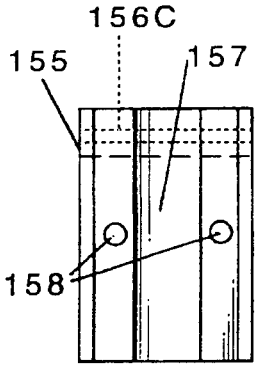
FIG. 15P (Prior Art)

FIG. 15P is a front plan view of a pivot post for pivotal attachment to the body of FIG. 13P, and to which a motorized device can be secured.

Figure 16P:
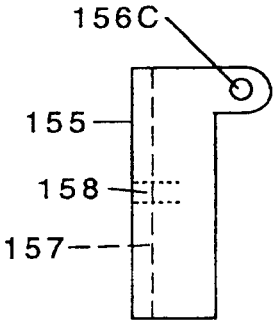
FIG. 16P (Prior Art)

FIG. 16P is a side plan view of the pivot post of FIG. 15P.

Figure 17P:
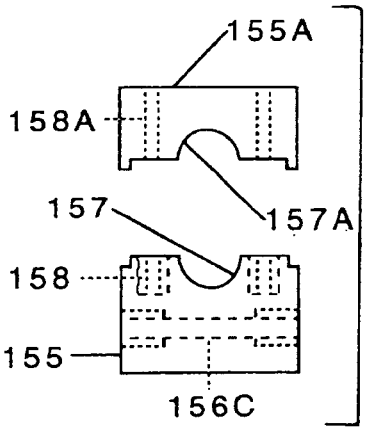
FIG. 17P (Prior Art)

FIG. 17P is a top, exploded plan view of the pivot post of FIG. 15P and an auxiliary cap which can be employed to assist in securing the motorized device with the pivot post and transom mount, to a boat.

Figure 1:
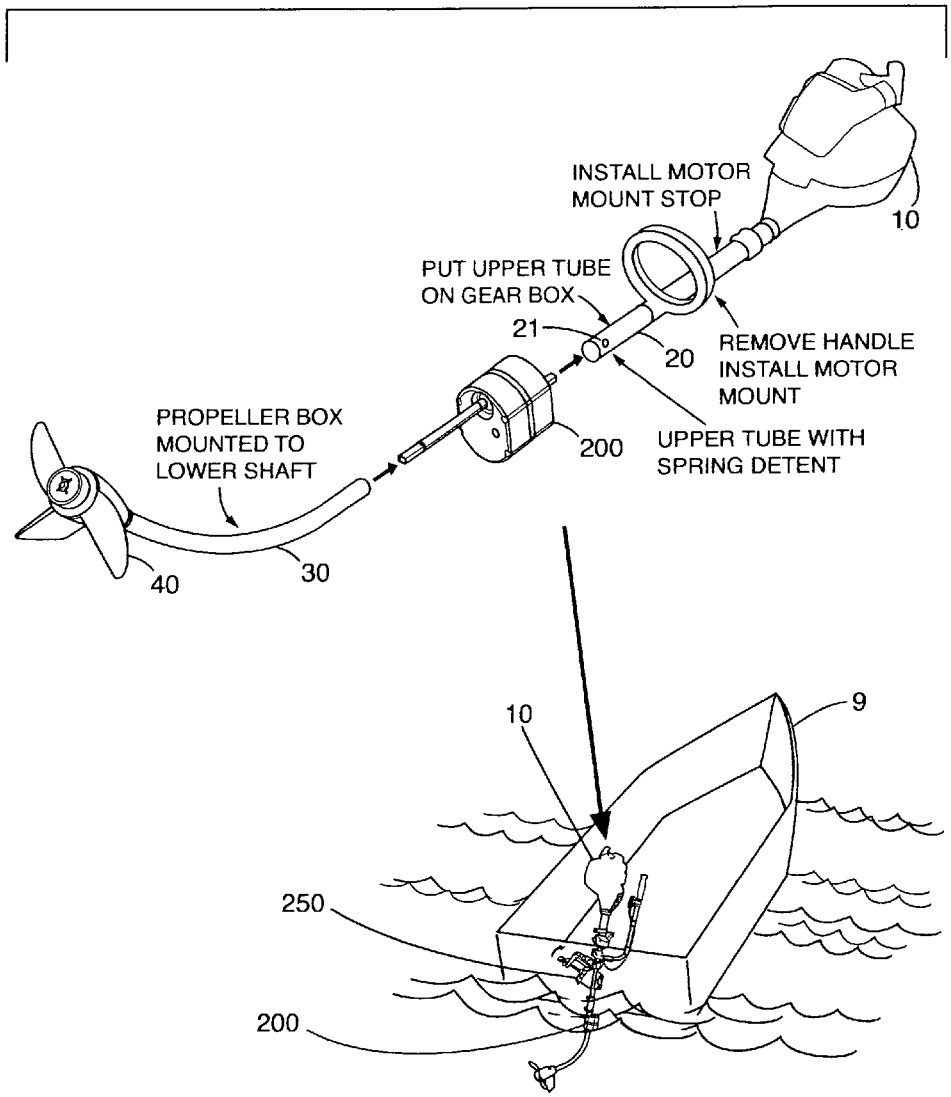
Figure 64:
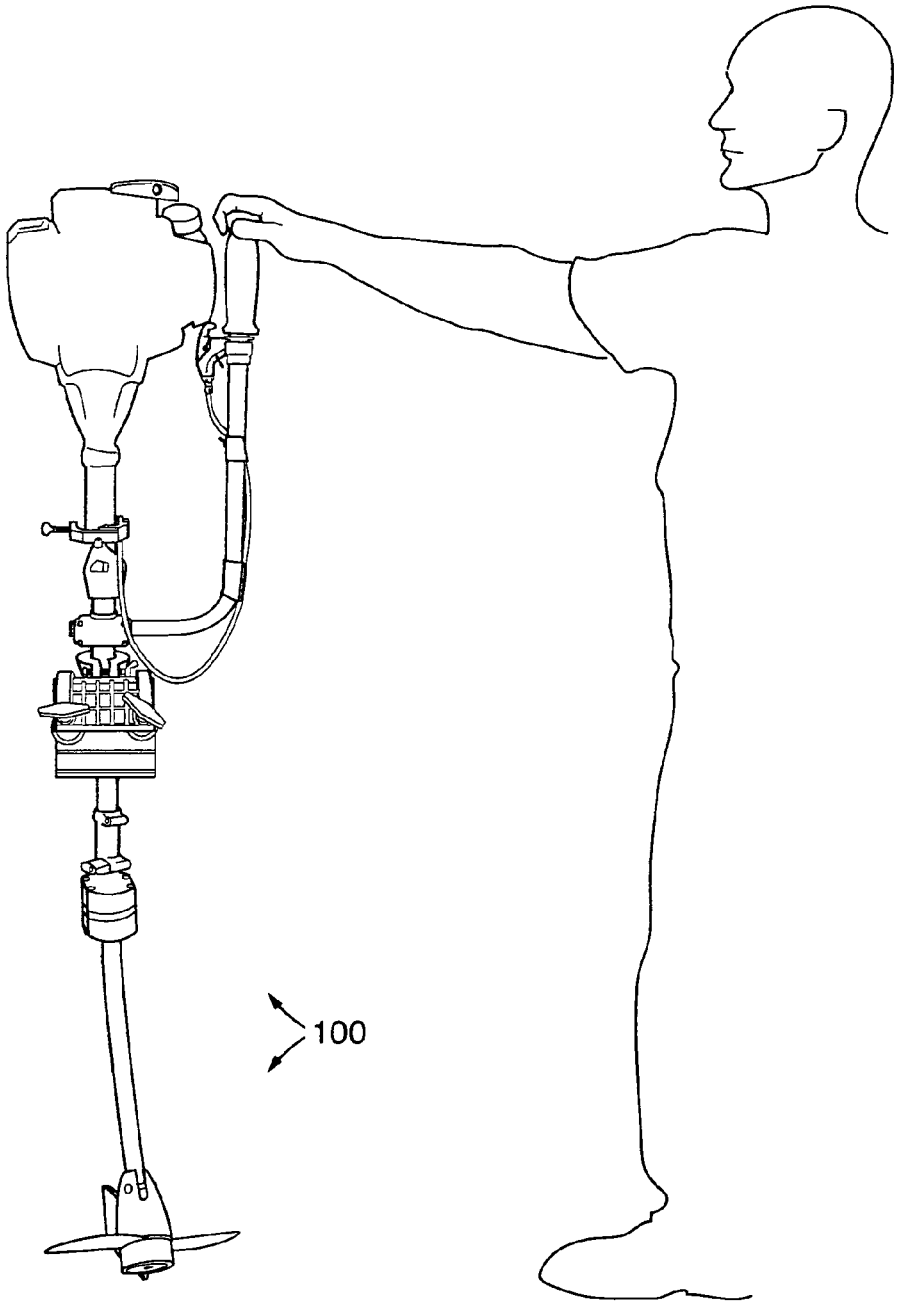

FIGS. 1-64 depict further drawings forming part of the specification hereof:

FIG. 1 is an exploded view of an embodiment of a weed-trimmer outboard motor attachment with a motorized weed-trimmer device upper part including motor and shaft, which can be attached to and in turn propel a boat.

Figure 2:
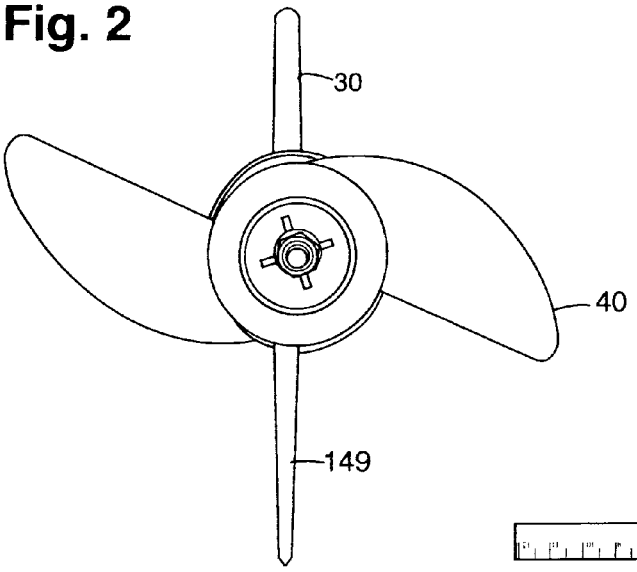

FIG. 2 is a rear view of a weed-trimmer outboard motor attachment otherwise as found in FIG. 2 without a built-in rotation speed reduction unit. The same can be used in an assembly of FIG. 1.

Figure 3:
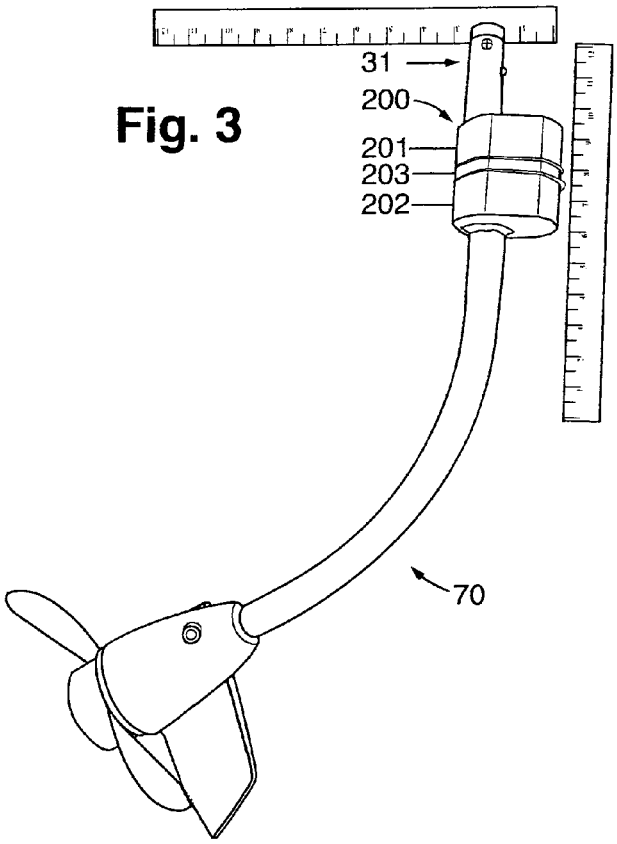

FIG. 3 is a side view of a weed-trimmer outboard motor attachment with a built-in rotation speed reduction unit, which employs gears (inside the speed reduction unit). The same can be used as in an assembly otherwise as of FIG. 1.

Figure 4:
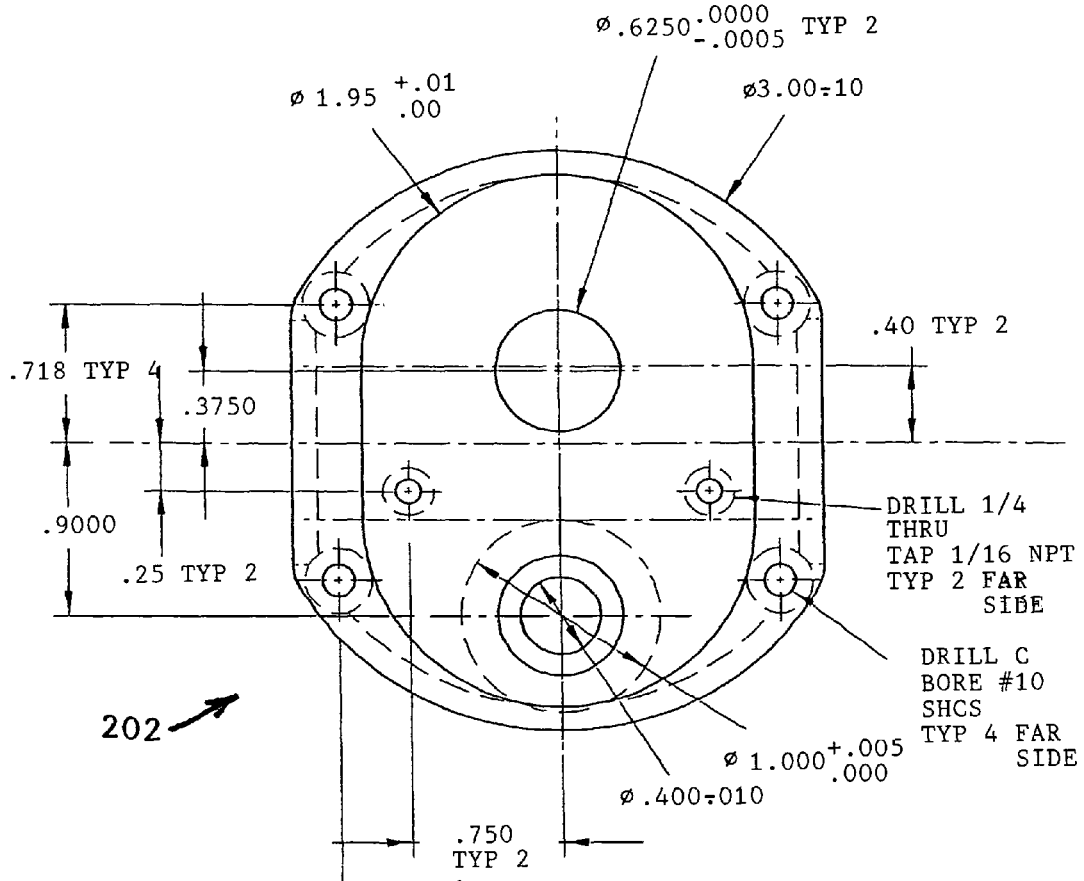

FIG. 4 is a top view of an input-side housing part for the rotation speed reduction unit found within FIG. 3.

Figure 5:
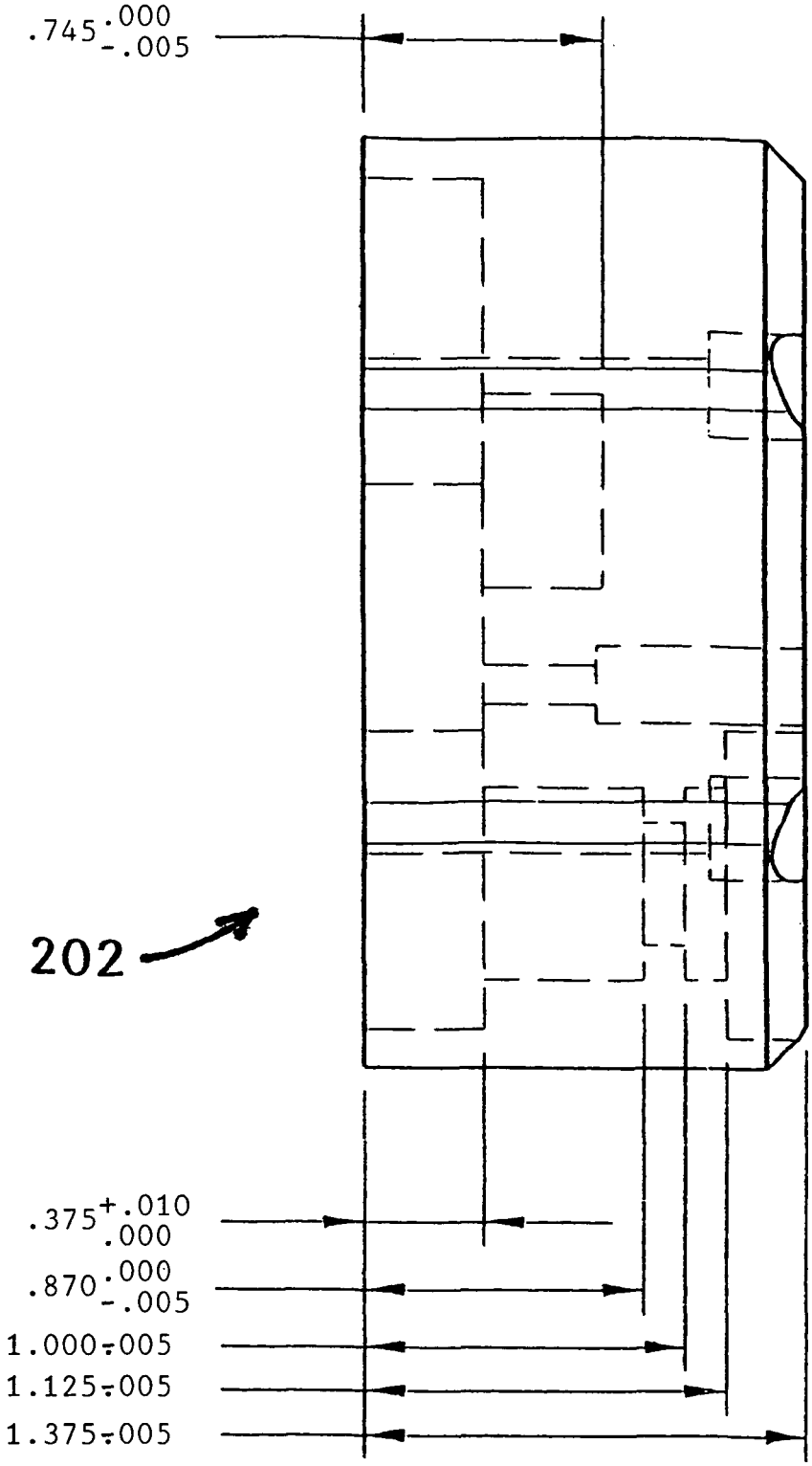

FIG. 5 is a side view of the input-side housing part of FIG. 4.

Figure 6:
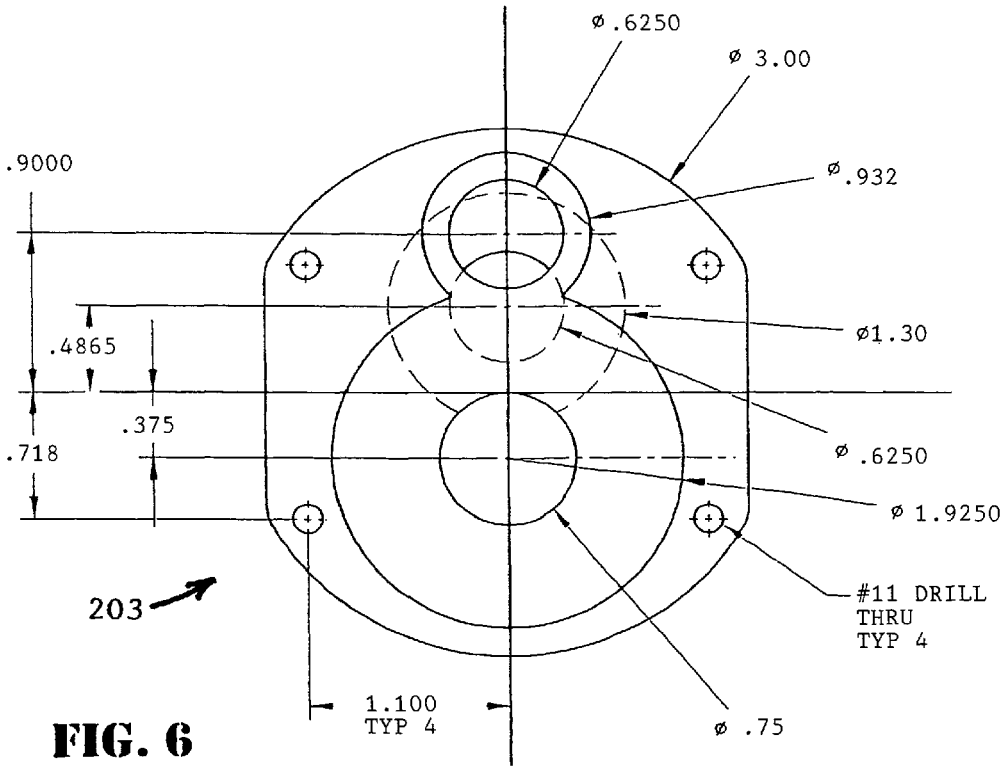

FIG. 6 is a top view of a center plate housing part for the rotation speed reduction unit found within FIG. 3.

Figure 7:
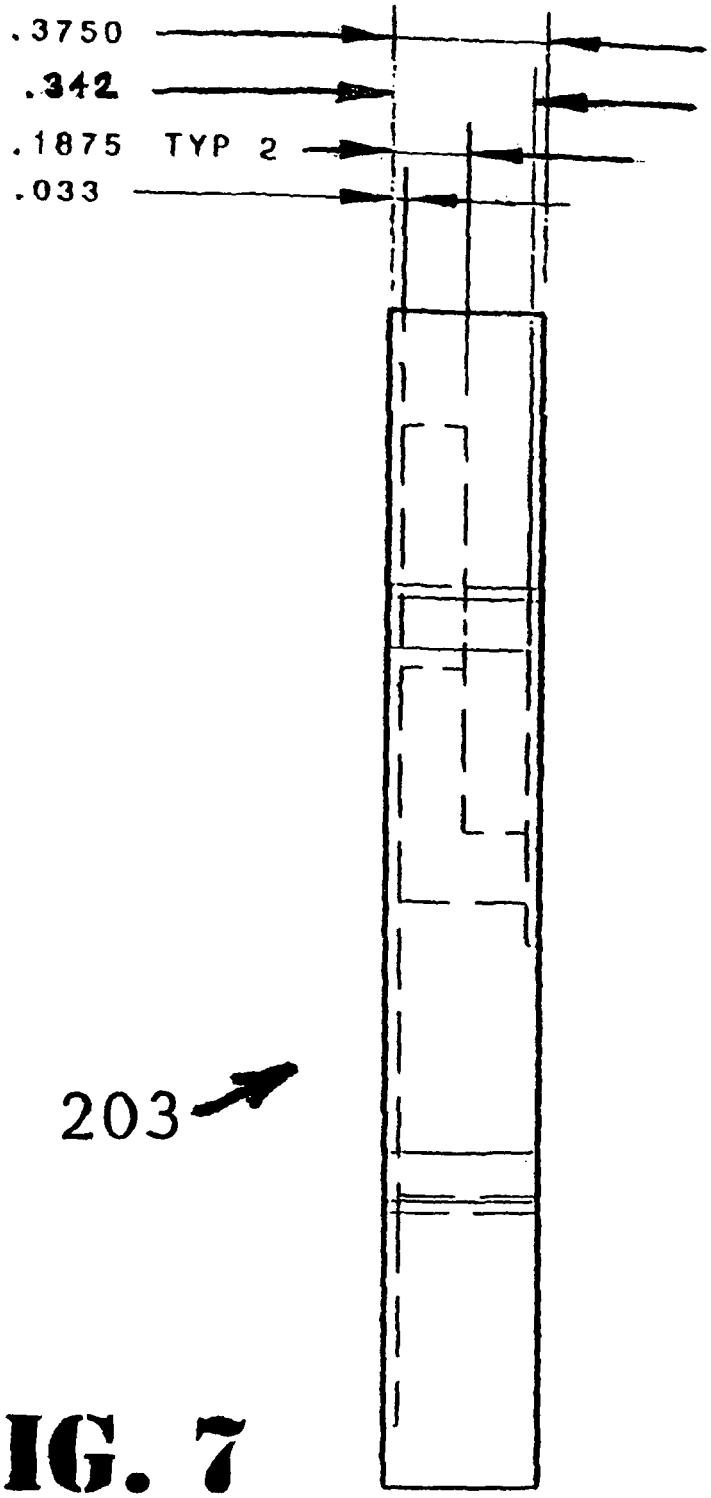

FIG. 7 is a side view of the center plate housing part of FIG. 6.

Figure 8:
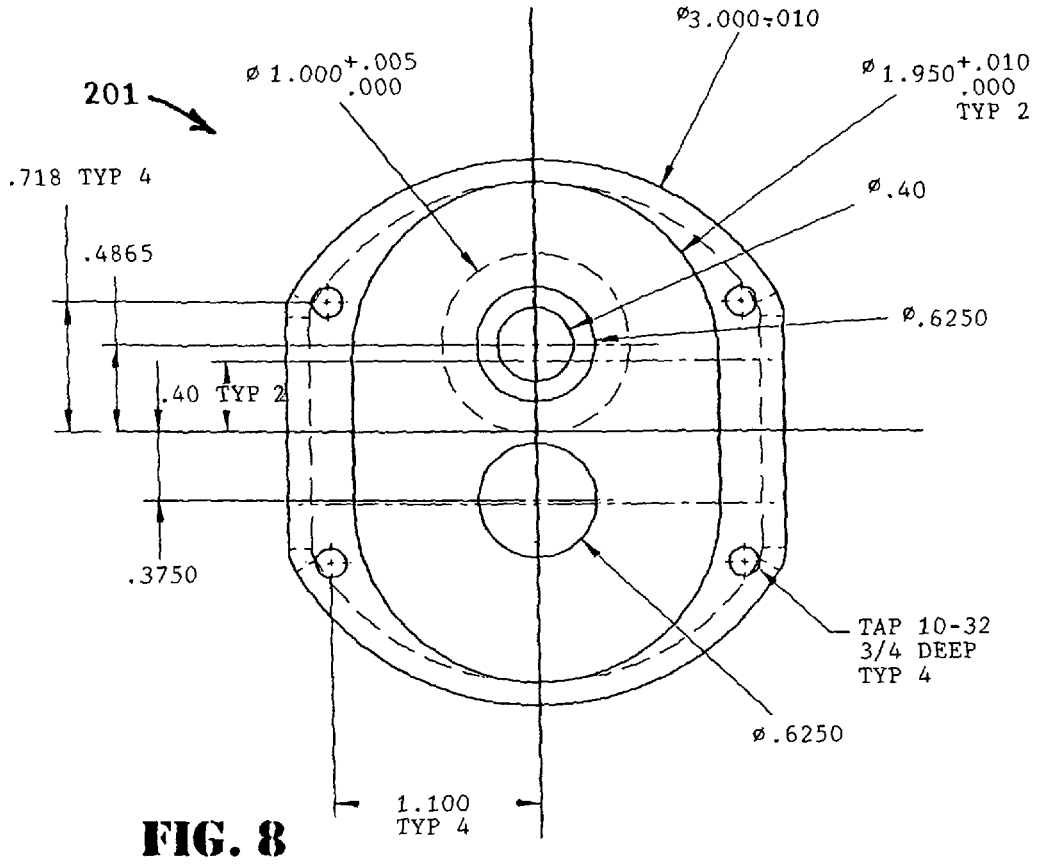

FIG. 8 is a top view of an output-side housing part for the rotation speed reduction unit found within FIG. 3.

Figure 9:
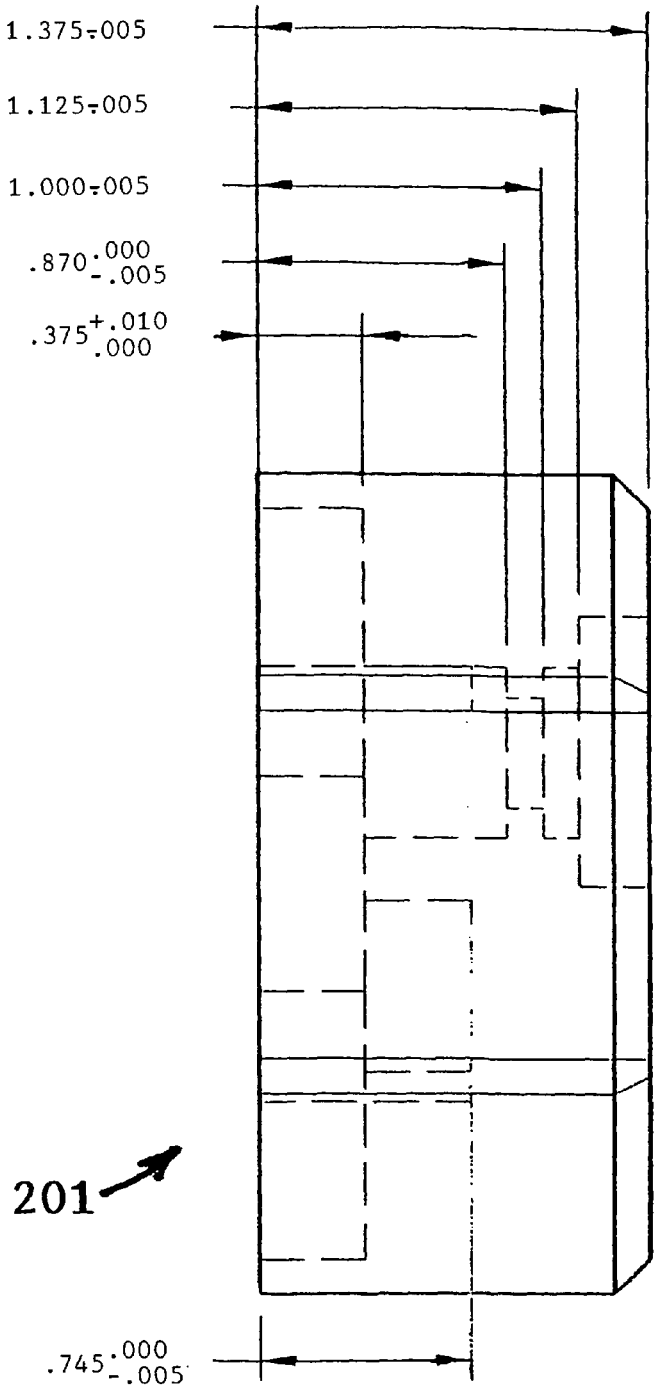

FIG. 9 is a side view of the output-side housing part of FIG. 8.

Figure 10:
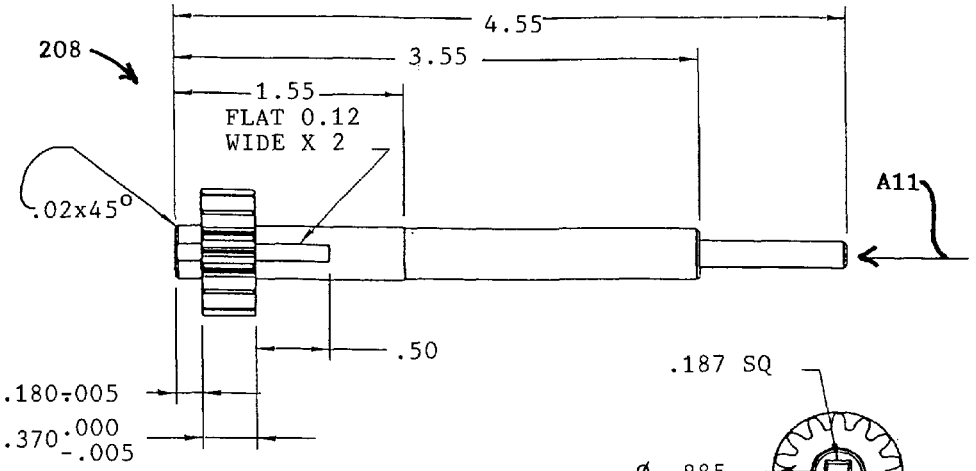

FIG. 10 is a side view of an input shaft with gear for the rotation speed reduction unit found within FIG. 3, which resides in a housing assembled with parts of FIGS. 4-9.

Figure 11:
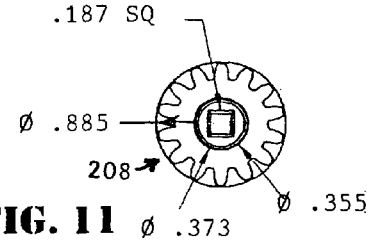

FIG. 11 is an end view of the input shaft with gear of FIG. 10, along the direction of arrow A11.

Figure 12:
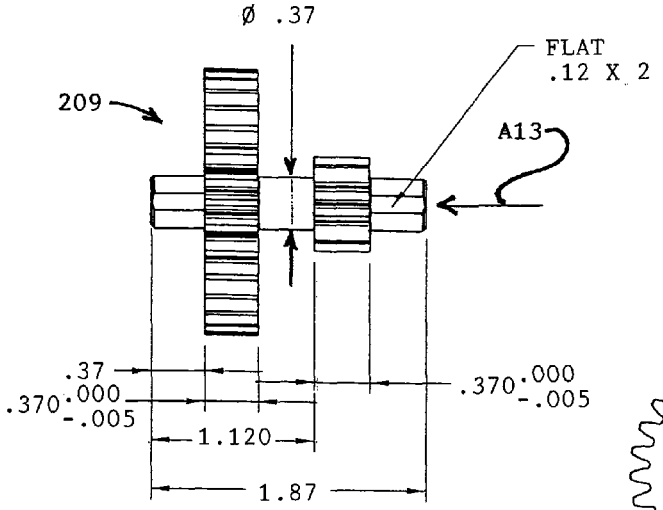

FIG. 12 is a side view of a cluster gear for the rotation speed reduction unit found within FIG. 3, which resides in the housing assembled with parts of FIGS. 4-9.

Figure 13:
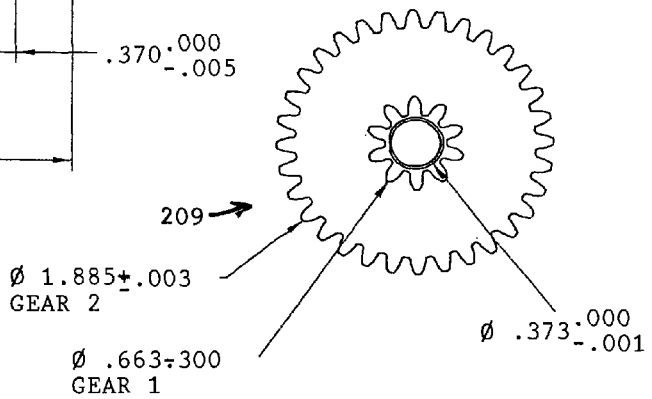

FIG. 13 is an end view of the cluster gear of FIG. 12, along the direction of arrow A13.

Figure 14:
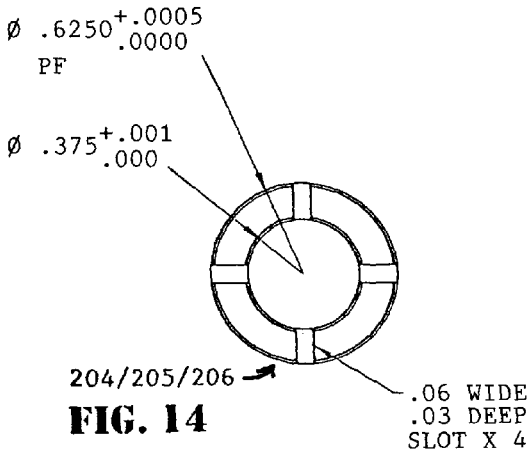

FIG. 14 is a top view of a bushing for the rotation speed reduction unit found within FIG. 3, which resides in the housing assembled with parts of FIGS. 4-9.

Figure 15:
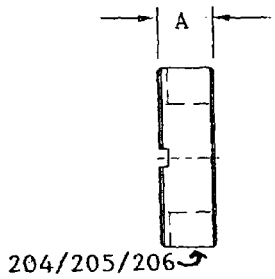

FIG. 15 is a side view of the bushing of FIG. 14.

Figure 16:
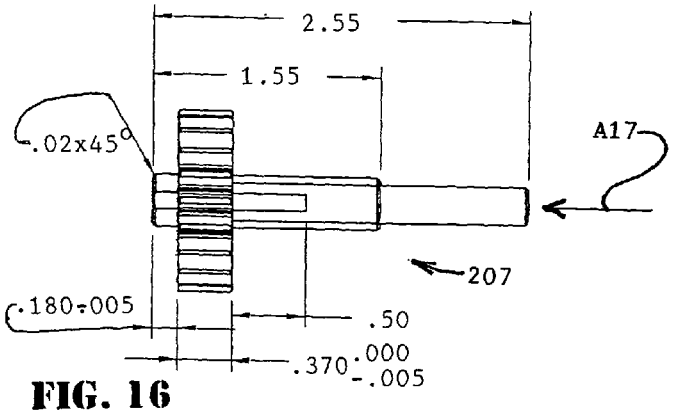

FIG. 16 is a side view of an output shaft with gear for the rotation speed reduction unit found within FIG. 3, which resides in the housing assembled with parts of FIGS. 4-9.

Figure 17:
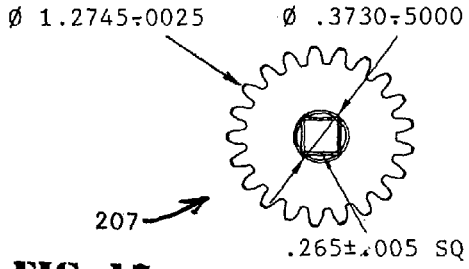

FIG. 17 is an end view of the output gear of FIG. 16, along the direction of arrow A17.

Figure 18:
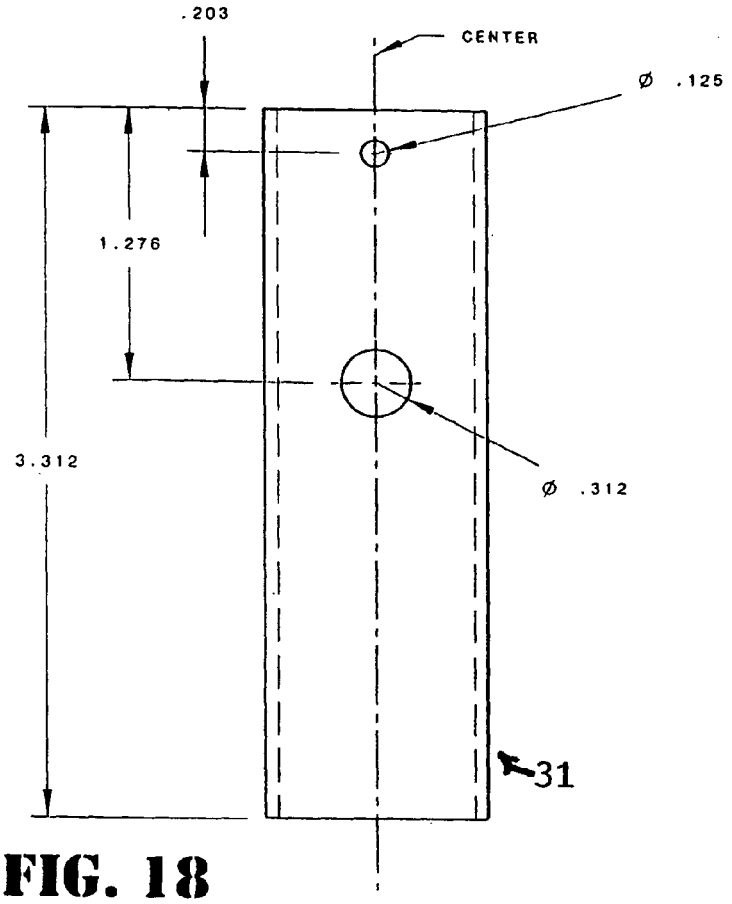

FIG. 18 is a side view of an upper tube section for a spring detent of the weed-trimmer outboard motor attachment with built-in rotation speed reduction unit of FIG. 3.

Figure 19:
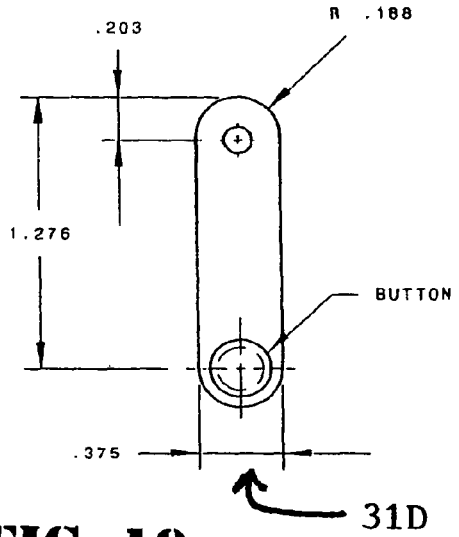

FIG. 19 is a top view of a detent for the upper tube section of FIG. 18.

Figure 20:
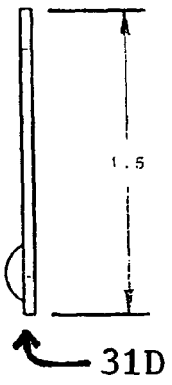

FIG. 20 is a side view of the detent of FIG. 19.

Figure 21:
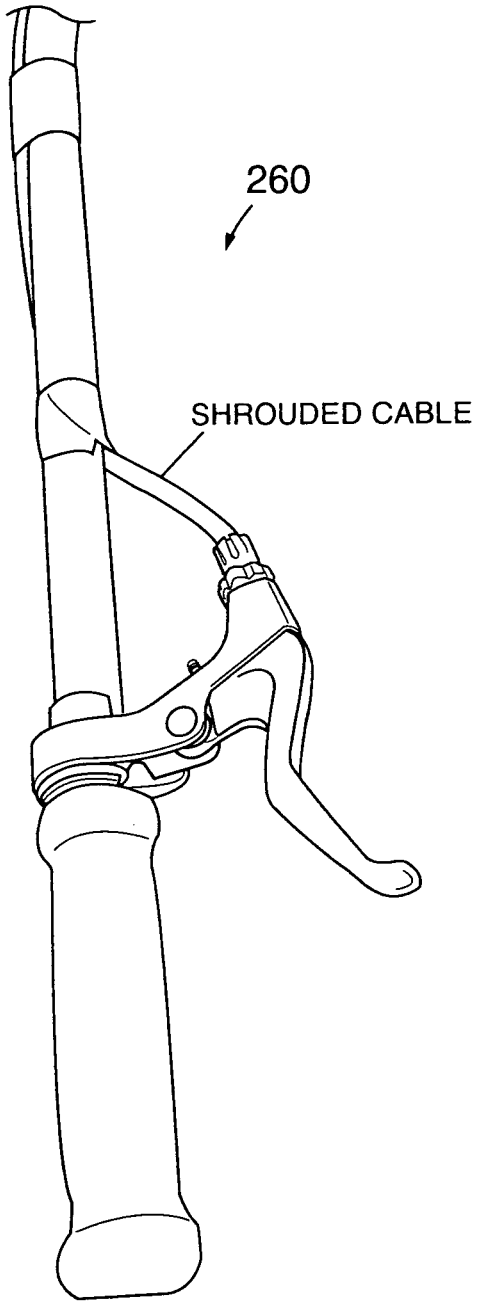

FIG. 21 is a view of an assembled, mounted throttle handle that can be used with a weed-trimmer outboard motor such as of FIGS. 1-3 et seq.

Figure 22:
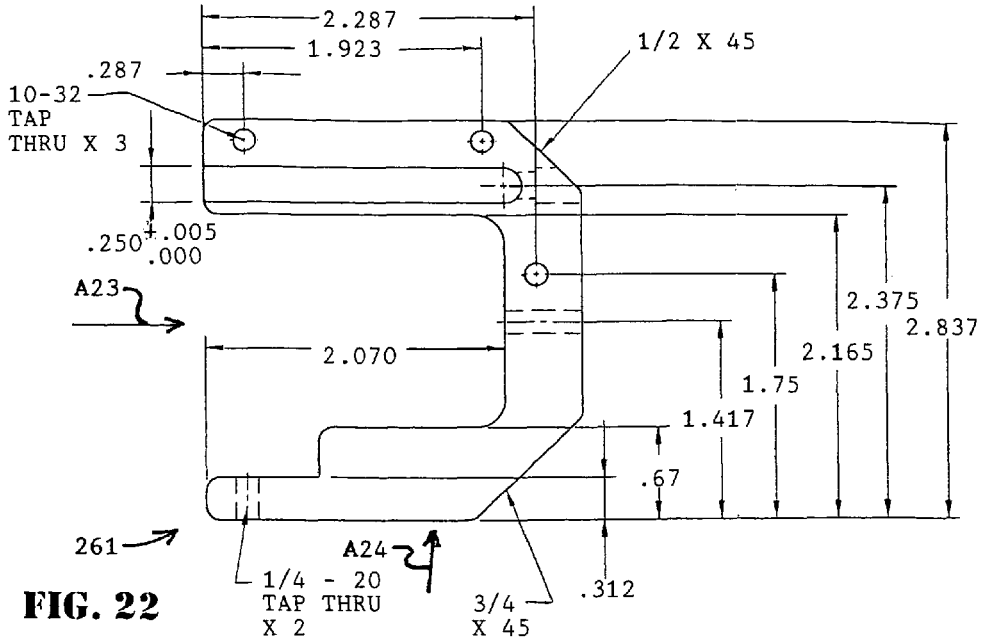

FIG. 22 is a top view of a throttle body found within the throttle of FIG. 21.

Figure 23:
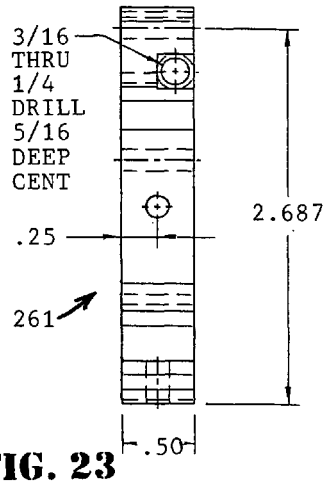

FIG. 23 is an end view of the throttle body of FIG. 22, taken along the direction of arrow A23.

Figure 24:
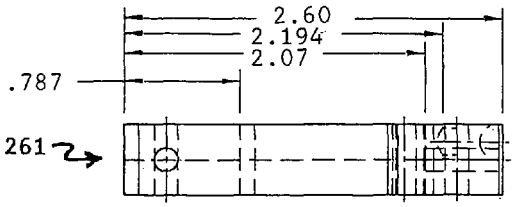

FIG. 24 is a side view of the throttle body of FIG. 22, taken along the direction of arrow A24.

Figure 25:
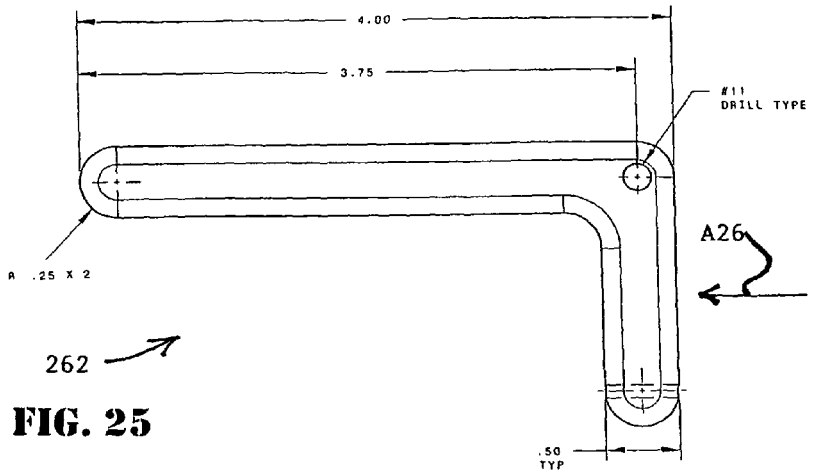

FIG. 25 is a side view of a throttle handle found within the throttle body of FIG. 22, with attachment by a nut and bolt.

Figure 26:
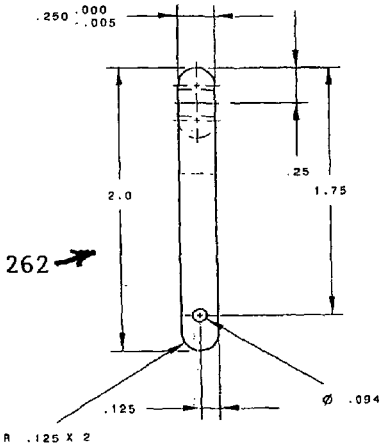

FIG. 26 is an end view of the throttle handle of FIG. 25, taken along the direction of arrow A26.

Figure 27:
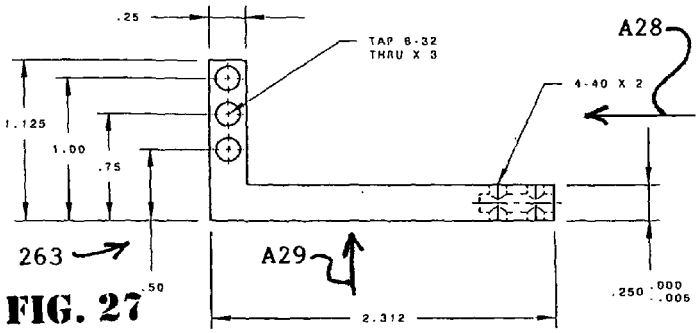

FIG. 27 is a side view of a throttle rod found within the throttle body of FIGS. 23 and 24. It is attached to throttle cable slides in a pocket of the body of FIGS. 23 and 24.

Figure 28:
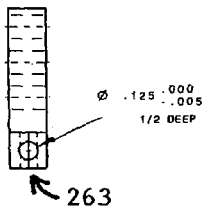

FIG. 28 is an end view of the throttle rod of FIG. 27, taken along the direction of arrow A28.

Figure 29:
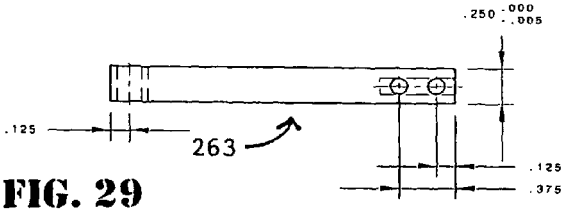

FIG. 29 is a top view of the throttle rod of FIG. 27, taken along the direction of arrow A29.

Figure 30:
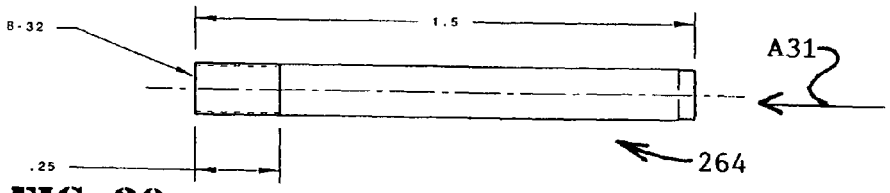

FIG. 30 is a side view of a throttle pin found within the throttle rod of FIGS. 27-29 attached by threading.

Figure 31:
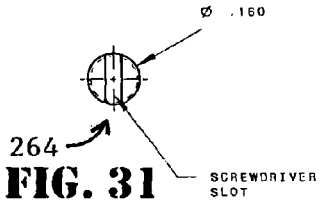

FIG. 31 is an end view of the throttle pin of FIG. 30, taken along the direction of arrow A31.

Figure 32:
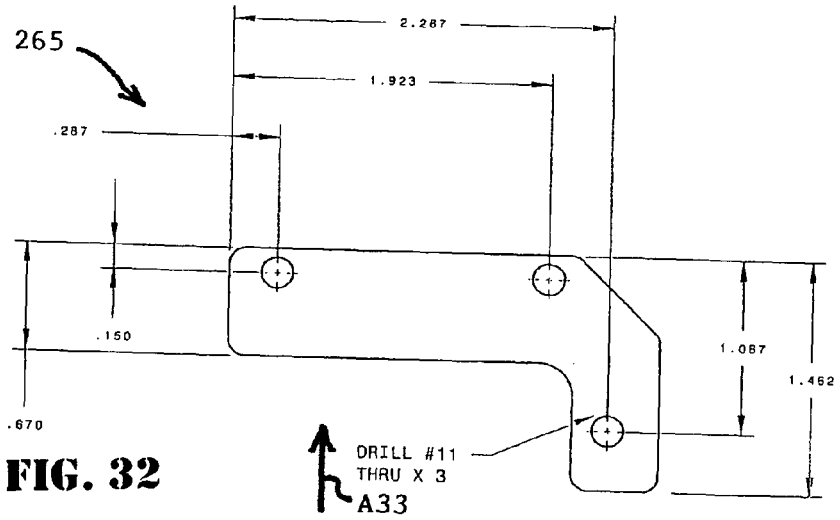

FIG. 32 is a top view of a throttle body cap found within the throttle of FIG. 21.

Figure 33:
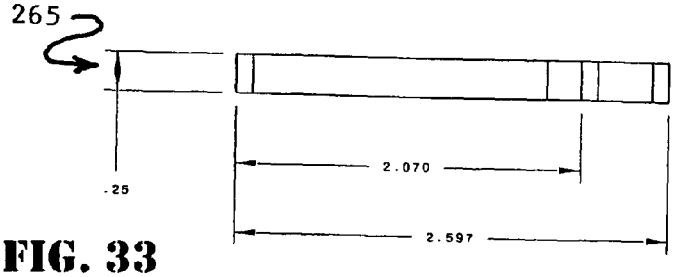

FIG. 33 is a side view of the throttle body cap of FIG. 32, taken along the direction of arrow A33.

Figure 34:
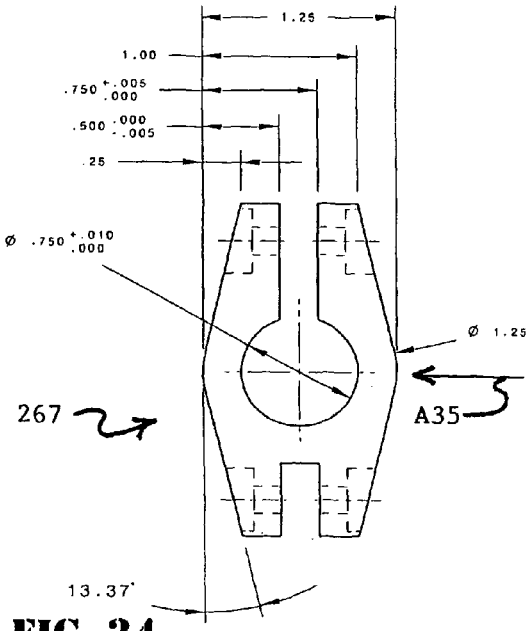

FIG. 34 is a top view of a handle clamp that can be employed with the throttle lever of FIG. 25 by a nut and bolt.

Figure 35:
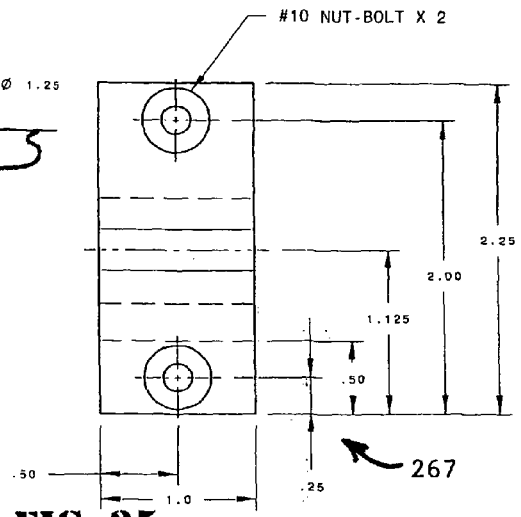

FIG. 35 is an elevational view of the handle clamp of FIG. 34, taken along the direction of arrow A35.

Figure 36:
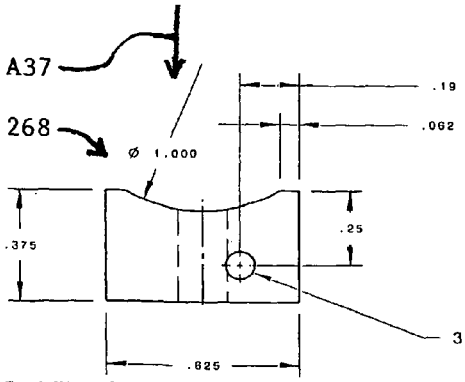

FIG. 36 is a side view of a clamp pad that can be employed with the thumb screw of FIG. 21, retained with a split pin.

Figure 37:
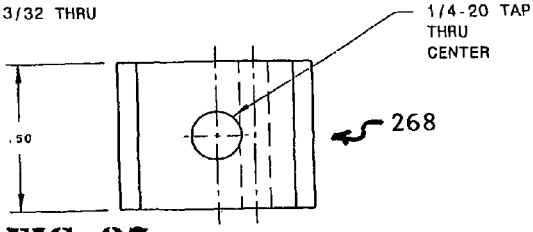

FIG. 37 is a top view of the clamp pad of FIG. 36, taken along the direction of arrow A37.

Figure 38:
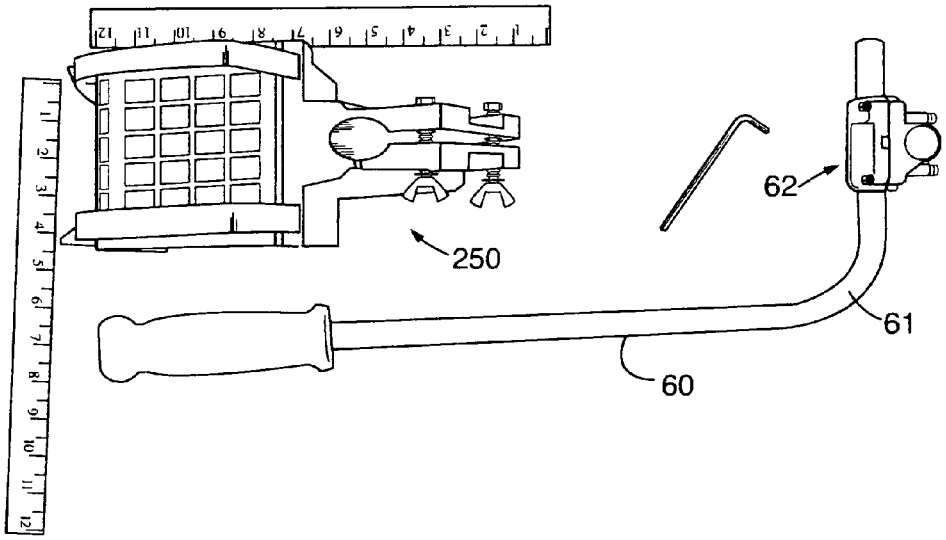

FIG. 38 is a top view of a mount for a weed-trimmer outboard motor alongside a tiller arm that can be attached to an outer shaft housing of an upper part of a motorized weed-trimming device for the weed-trimmer outboard motor.

Figure 39:
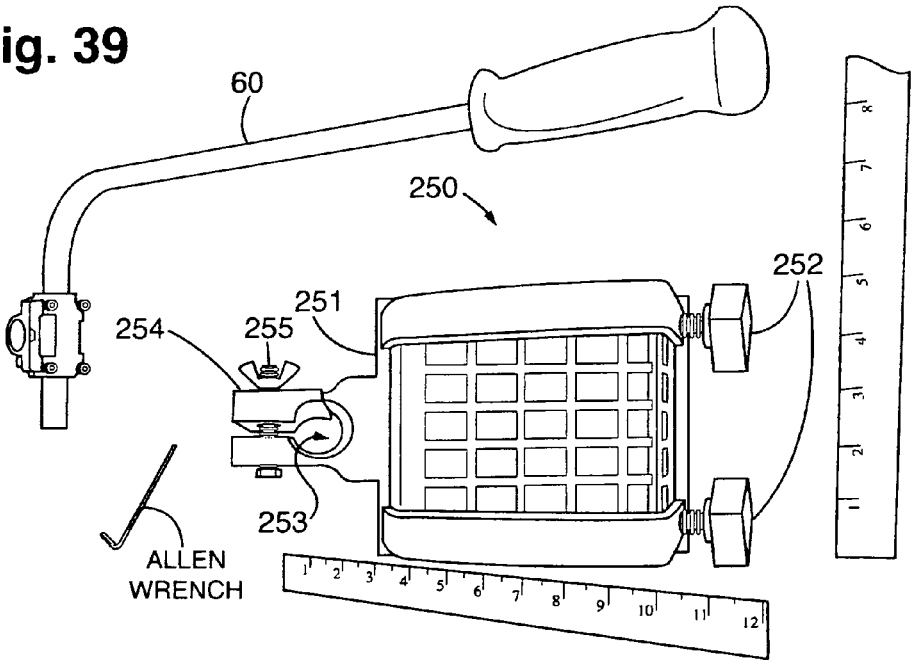

FIG. 39 is a top perspective view of the mount and tiller arm parts in FIG. 38.

Figure 40:
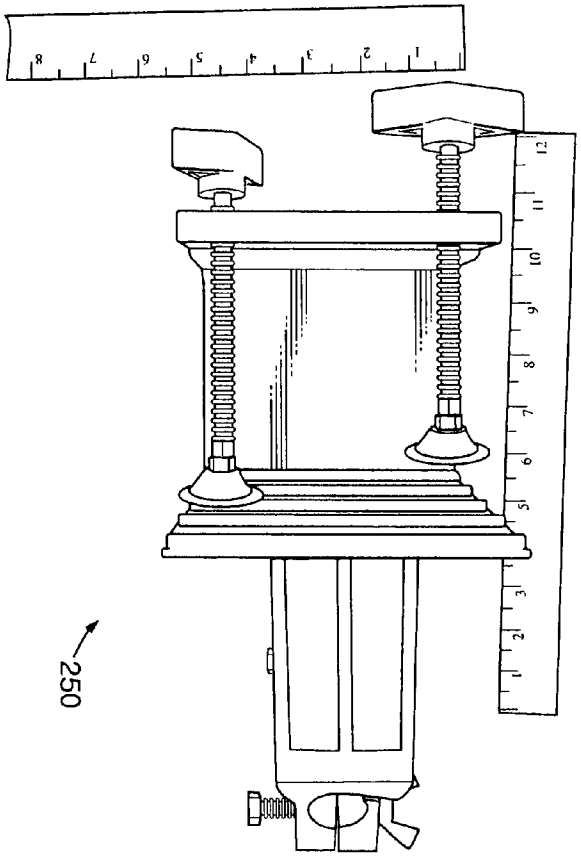

FIG. 40 is a bottom view of the mount found within FIG. 39.

Figure 41:
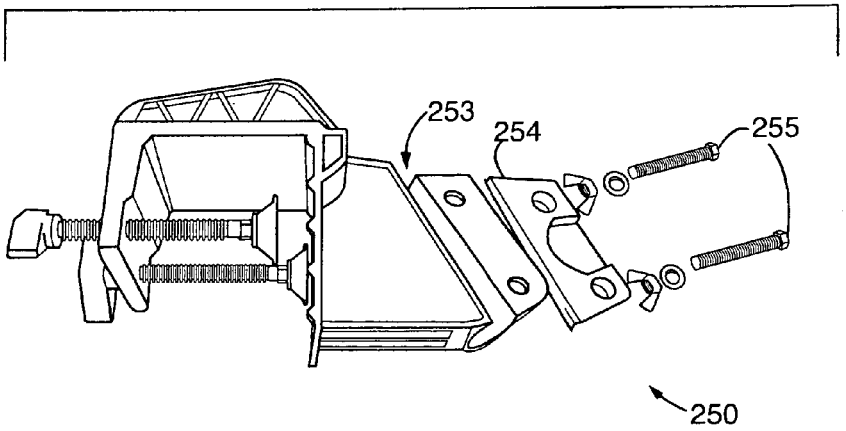

FIG. 41 is an exploded side perspective view of the mount of FIG. 40.

Figure 42:
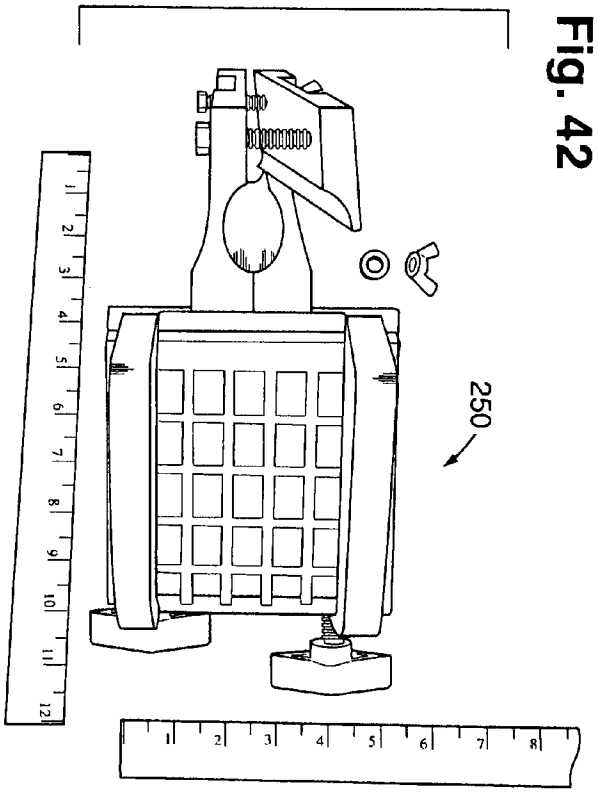

FIG. 42 is a top view of the mount of FIG. 40, partially assembled and ready to receive the weed-trimmer outboard motor.

Figure 43:
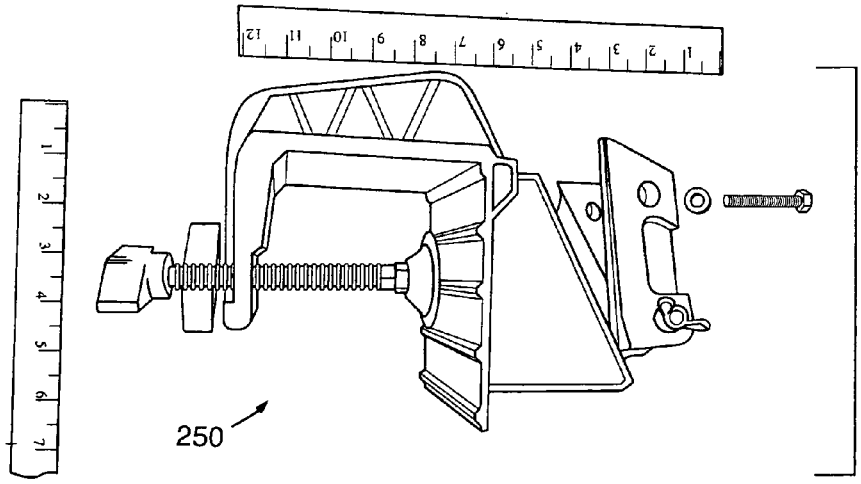

FIG. 43 is a side view of the mount of FIG. 40, partially assembled and ready to receive the weed-trimmer outboard motor.

Figure 44:
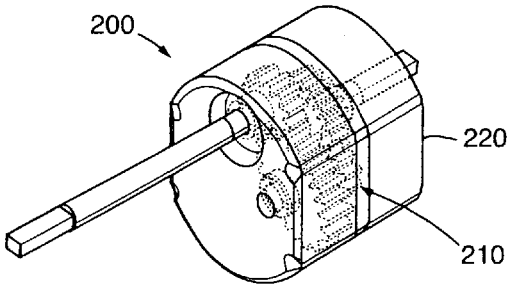
Figure 45:
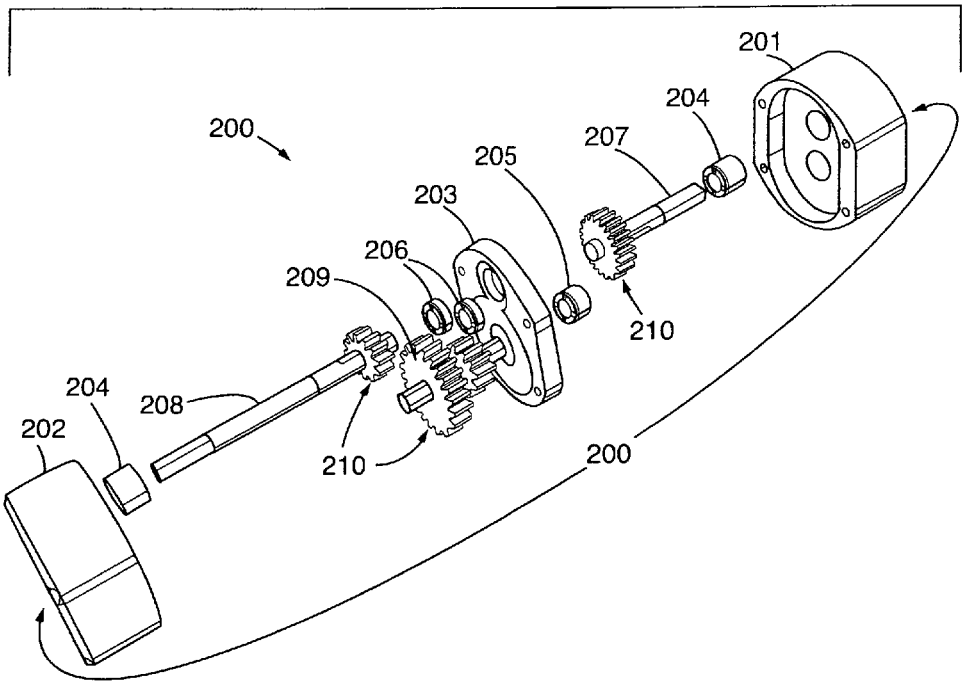
Figure 46:
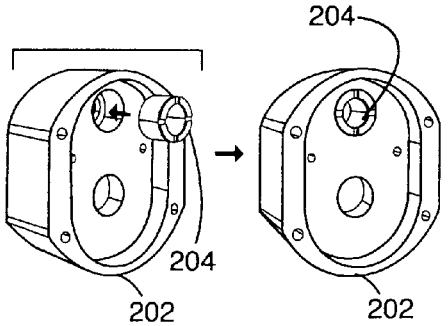
Figure 47:
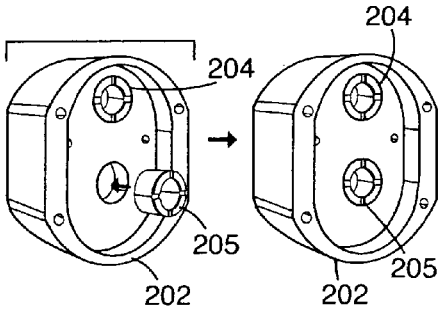
Figure 48:
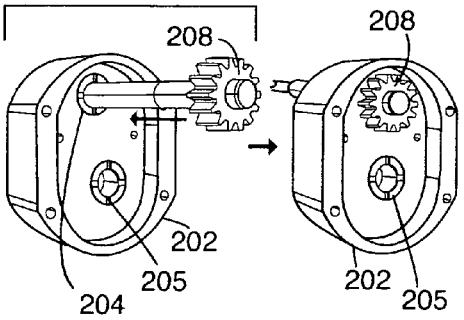
Figure 49:
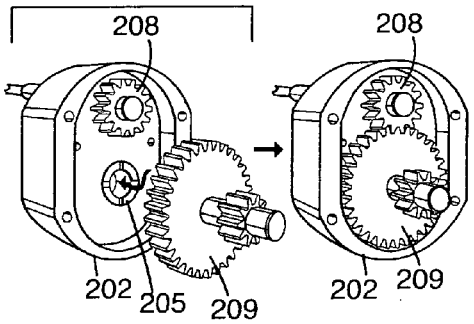
Figure 50:
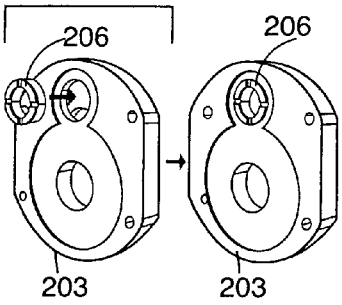
Figure 51:
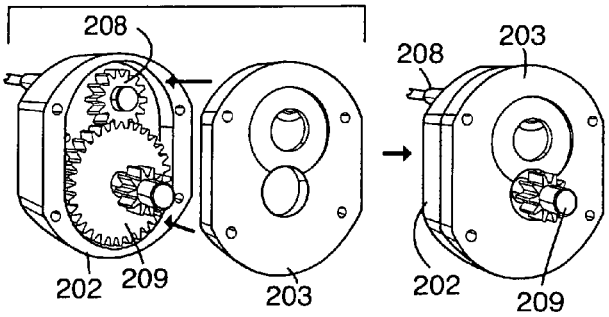
Figure 52:
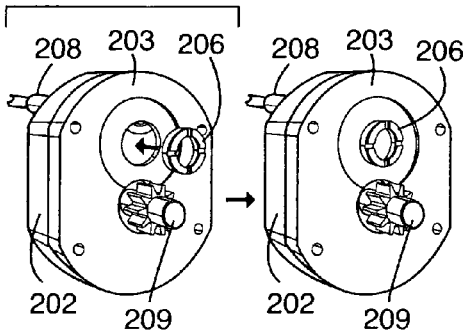
Figure 53:
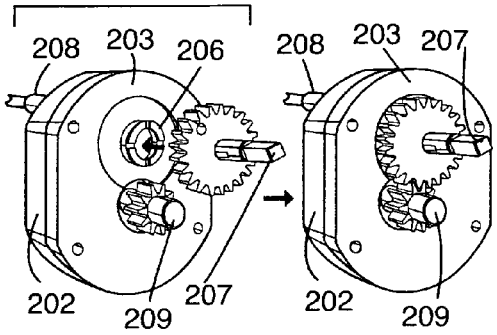
Figure 54:
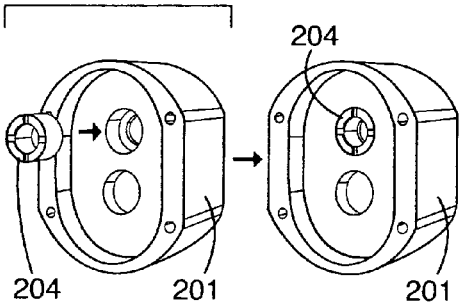
Figure 55:
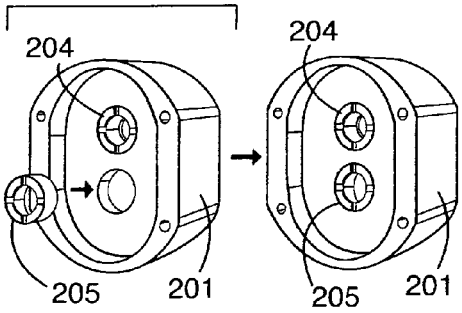
Figure 56:
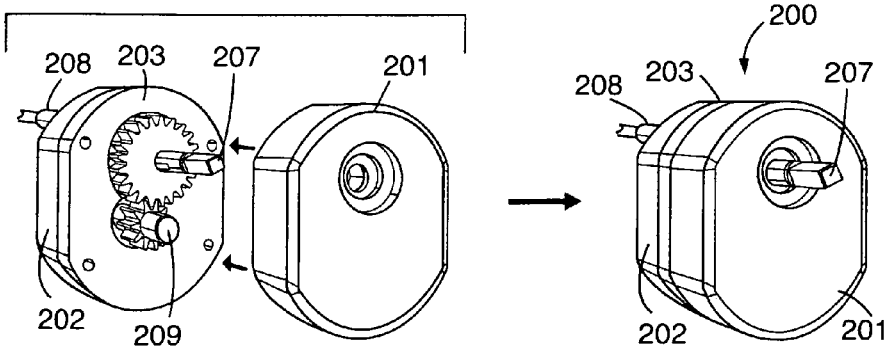

FIG. 44 is a plan view of an assembled rotation speed reduction unit with gears.

Figure 57:
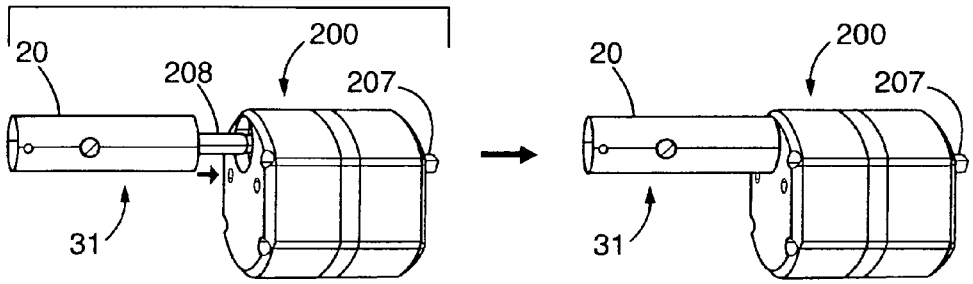
Figure 58:
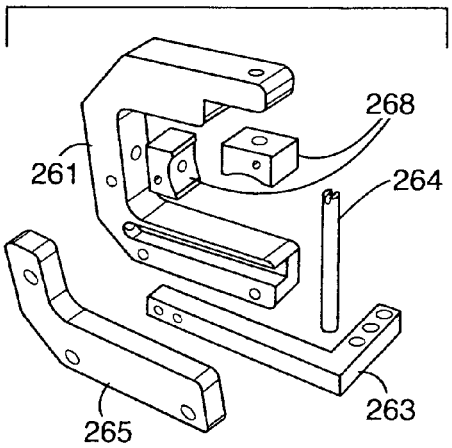
Figure 59:
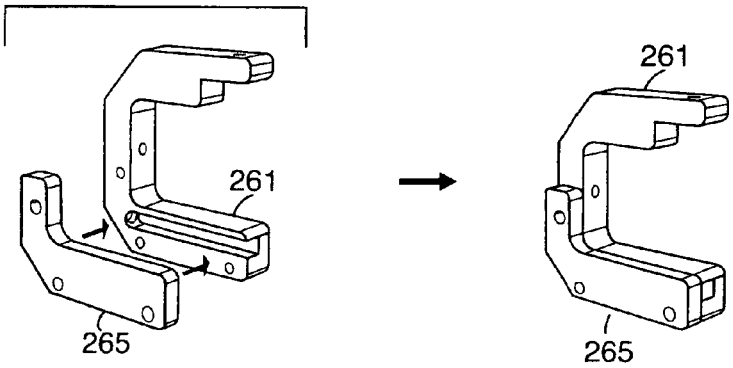
Figure 60:
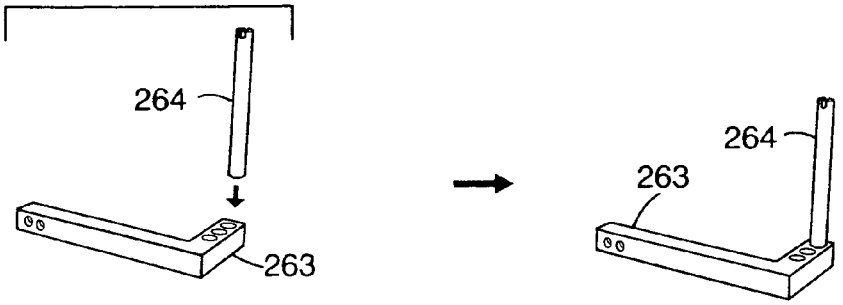
Figure 61:
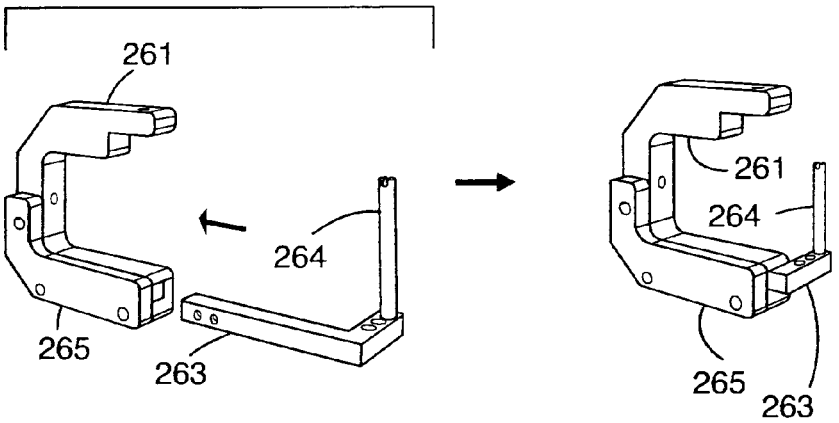
Figure 62:
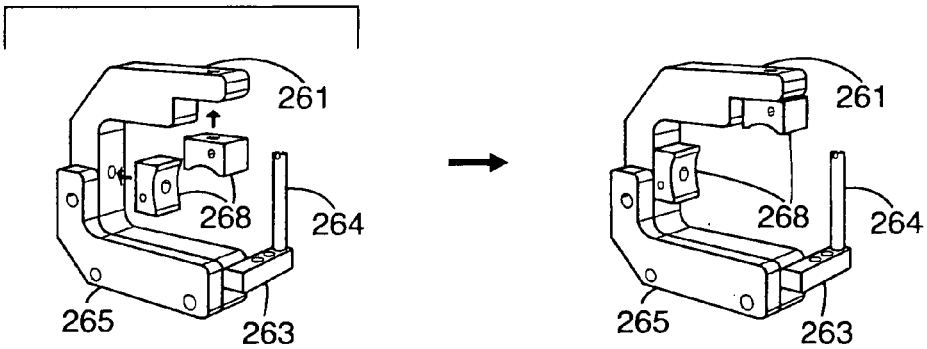

FIGS. 45-56 illustrates assembly of the speed reduction unit of FIG. 44, comparing FIG. 3 et seq., and FIG. 57 illustrates assembly of an upper tube with detent to input side of the speed reduction unit of FIG. 44, comparing FIG. 18 et seq. In assembly, grease and other lubricants (not illustrated) are added during all bushing and gear installations, along with a final oil fill after assembly of the speed reduction unit.

FIGS. 58-62 show assembly of a throttle mechanism, comparing FIG. 21 et seq.

Figure 63:
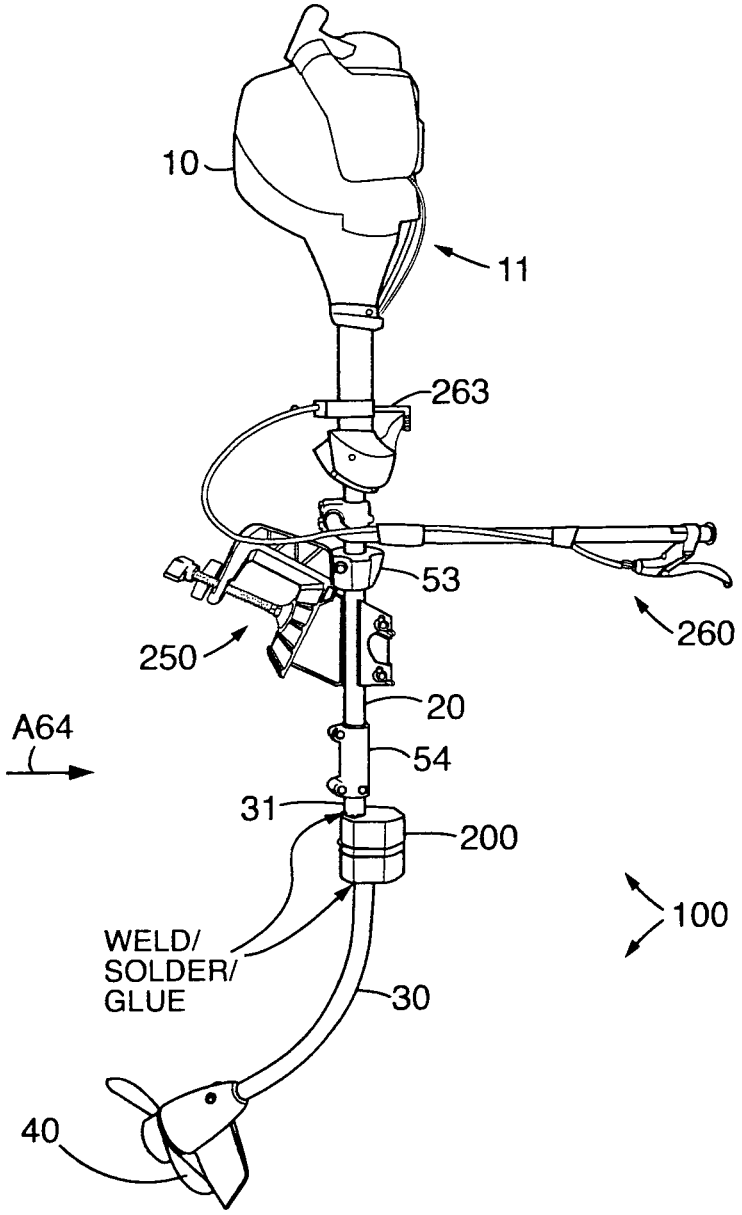

FIG. 63 is a side view of a weed-trimmer outboard motor assembled with mount generally in a position rotated opposite to that in which the weed-trimmer outboard would be when mounted to a boat transom. Compare, FIGS. 1 and 3-62.

FIG. 64 is another view of the weed-trimmer outboard motor assembled with mount of FIG. 63, taken along the direction of arrow A64.

The invention can be further understood through a reading of the present detail, which may be viewed in conjunction with the drawings. The same is to be taken in an illustrative and not necessarily limiting sense.

In general, the present invention resides in a propeller attachment for a motorized weed-trimming device, and their combination and use. The weed-trimming device part can be supplied by an electric- or gasoline-powered weed-trimmer, and so forth and the like, say, of the gasoline-powered variety. For example, it may be a basic string-type weed-trimmer power plant and shaft made by any of a host of manufacturers of such devices such as a Ryobi, Model 750r, or another model, or any other suitable make and model, say, from John Deere, Echo, Homelite, or another manufacturer. Preferably, the weed-trimmer device part is able to receive various adaptations on its drive shaft by replacement such as those known in the art such as a string-trimmer head, saw to cut brush, sidewalk-trimmer, rotary soil-tiller, and so forth and the like. Thus, it may be considered to be of the breakdown or reversible type. As the propeller, a plurality of propellers may be employed, to include as a gang or in series. A rotation speed reduction unit may be present as a separable intermediate attachment or built-in with the rest of the propeller attachment. In general, the propeller (or propellers) is (or are) sized and tuned to the output of the weed-trimmer power plant and rotation speed reduction unit. When combined with the weed-trimmer device part, the propeller attachment and rotation speed reduction unit provide for the present weed-trimmer outboard motor. A mount for mounting the weed-trimmer outboard motor to a boat can assist in simply and effectively securing the motor to the boat and in performance in the water.

With reference to the drawings, gasoline-powered string weed-trimmer outboard motor 100 may be mounted to boat 9, and can include standard power plant 10, for example, an 1800-RPM 1.0-HP 2-cycle, air-cooled engine, with accelerator control line 11 and upper shaft housing 20 which terminates in distal mid-shaft coupling 21, which may include hole. Lower shaft housing 30 with proximal coupling 31, say, of aluminum, for example, a detent-pin-and-button 31D arrangement, say, of spring steel, to correspondingly mate and engage the hole with the coupling 21 is provided at its distal terminus with propeller 40, and such a lower shaft housing containing unit may be referred to simply as attachment 70. Included with the attachment 70 can be rotation speed reduction unit 200, which can reduce the number of rotations of the propeller in relation to the number of rotations of the motor of the motorized weed-trimming device any suitable amount, for instance, independently at each occurrence in terms of a ratio of rotations of the motor to rotations of the propeller (motor:propeller) about from 1.5:1 to 15:1, to include about from 3:1 to 10:1, and about from 4:1 to 7:1, for example, 4.8:1 or thereabout. When the upper and lower shafts 20, 30 are coupled, and the power plant 10 is operated so as to drive a drive shaft to include any couplings inside the shaft 20, 30, with rotation speed reduction from the rotation speed reduction unit 200, the propeller 40 rotates. When the attached propeller 40 provided with the proper shape, pitch, and diameter, is placed in water and run, it can effectively and efficiently operate so as to provide the weed-trimmer outboard motor 100.

The speed reduction unit 200 can have any suitable configuration or construction for reducing the number of rotations of output from those of input and be made of any suitable material, and may include those which employ gears 210 mounted on shafts 207, 208, 209; pulley(s) and belt(s) or rope(s); sprocket(s) and chain(s); toothless dowels of different sizes in rotatable contact with each other; fluid(s); magnetic force(s); and so forth. For example, the gears 210 can be made, for example, with sintered metal (HT RC 48-52), with any bushing(s) made of steel (HT RC 58-62). Thus, there may be output shaft with gear 207 (e.g., 21-tooth, 18-pitch, 20° pitch angle gear), input shaft with gear 208 (e.g., 14-tooth, 18-pitch, 20° pitch angle gear), cluster gear 209 (e.g., 10-tooth, 18-pitch, 20° pitch angle smaller gear and 32-tooth, 18-pitch, 20° pitch angle larger gear), and bushings 204 (e.g., two, each 0.5000+0.002−0.000 inch width A), 205 (e.g., two, each 0.3750+0.002−0.000 inch width A), 206 (e.g., two, each 0.1875+0.002−0.000 inch width A) mounted in housing 220, for example, of aluminum, which includes output side block 201, input-side block 202, and center plate 203. Thus, a reduction in rotation can be effected from the input-side and the upper shaft 20 to the output-side and lower shaft 30 and in turn the propeller 40.

The weed-trimmer outboard motor 100 can further contain mount 250, tiller handle 60 and throttle 260. The mount 250 may be made, for example, from cast aluminum or molded plastic and have body 251, transom-engaging screws 252, and sleeve 253 with flap 254 and flap-securing screws 255, which together holds the shaft housing 20 so that the weed-trimmer outboard motor 100 can be secured, yet rotatably swivel about the shaft housing 20. Upper stop 53 can be provided by a collar or the like encircling the upper shaft housing 20, and lower stop 54 may be provided by the proximal part of fastening collar 22. In the fastening collar 22 can be screw 23. The tiller handle 60 can be of any suitable shape or design, for example, being made of an L-shaped Aluminum tube 61 mounted to the upper shaft housing 20 by frame and bolt assembly 62. The tiller 60 beneficially mounts throttle 260, which can be connected to the accelerator control line 11 of the weed-trimmer motor to control the speed of the engine 10 and, in turn, the speed of the boat 9. The throttle 260 can include throttle body 261, for example, of aluminum; throttle handle 262, for example of nylon plastic; throttle rod 263, for example, of aluminum; throttle pin 264, for example, of brass; and throttle body cap 265, for example, of aluminum. Handle clamp 267, for example, of nylon plastic, can be provided; and clamp pad 268, for example, of nylon plastic, can be provided to thumb screw. Compare, accelerator control, say, trigger 63, of the patent to Dompierre et al.

A weed-trimmer outboard motor 100 can include, in addition to or in lieu of the foregoing, the following features such as, in general, from U.S. Pat. No. 6,616,489 B1:

30 Lower shaft tube, e.g., with a 1-inch outside diameter, say, of aluminum, stainless steel, etc.

31L Lower flexible cable coupling, e.g., with an about 1-inch length and a square cross-section.

31U Upper flexible cable coupling, e.g., with an about 1-inch length and a square cross-section.

32 Flexible cable (core wire), e.g., with an about 14-inch overall length, including the cable couplings 31L and 31U.

33 Friction-fitting cable centering bushing, e.g., of molded ultra high molecular weight polyethylene. One or more may be present inside the tube 30, at one point or several points along the cable 32.

34 Inner stop spring, e.g., of spring steel.

36 Upper spring attachment fastener.

40 Propeller, e.g., with a blade tip to blade tip diameter of about 6¾ inches, a blade tip radius of about ¾ of an inch and an about 49-degree angle alpha (.alpha.) of the inner blade edge from the normal; say, of nylon, etc.

41 Propeller core.

42 Core countersink.

44 Inside core transfer arm receiving trough.

140 Transfer shaft, e.g., about ½-inch overall diameter by 3-inch length, say, of #304-stainless steel, etc.

141 Transfer shaft receptacle for receiving and mating with the lower coupling 31L.

142 Transfer shaft receiver end body.

143 Transfer shaft bearing surface.

144 Transfer arm, for receipt by and mating with the trough 44.

145 Transfer shaft distal end, with threaded tip.

146 Bushing bearing to accommodate the surface 143.

147 Propeller-securing nut.

148 Keel core, e.g., of nylon, etc., for registering with the propeller core 41 and with hole, for insert of fastener, e.g., screw, post, etc., through it and through a possible hole in the spring 34.

149 Keel fin.

In lieu of the mount 250 may be provided a swivel mount 50 or a transom mount 150, say, of nylon, etc., also such as found, in general, in U.S. Pat. No. 6,616,489 B1, which respectively may include the following features:

51 Swivel mount housing member.

52 Tube held by swivel mount housing member 51 and having inside diameter greater than outside diameter of the tube 20 for swiveling.

55 Post for insertion into a corresponding hole provided in the boat 9, which can be pivotally mounted to the member 51.

56 Pivot through which the post 55 cooperates.

151 Transom mount threaded holes for insert of bolts to secure mount over transom of boat.

155 Transom mount connectable pivot post.

155A Auxiliary cap for securing the tube 20 or 30, preferably 20, of the device 100 of the invention.

156C Transom mount pivot post connection hole for insert of rod, screw, etc., for pivotally connecting the post 156 to the transom mount main body.

156M Pivot post connection holes in the main body.

157 Pivot post outboard assembly receiver indent for receiving the tube 20 or 30, preferably 20.

157A Auxiliary cap receiver indent surface.

158 Pivot post threaded holes for receiving screw for mounting the cap 155A.

158A Auxiliary cap borehole for inserting the screw for mounting of the cap 155A to the post 155.

The following example further illustrates the invention.

EXAMPLE

A weed-trimmer outboard motor attachment according to FIGS. 3-37 and 44-64 is made and attached to the upper tube 20 of a gasoline-powered weed-trimmer device 10 and mounted. Mounting may be by a mount according to FIGS. 38-43. See, FIGS. 63 and 64. Compare, FIG. 1. It is tested in a laboratory setting in a barrel full of water and by running it to power a light boat about two hundred to two hundred twenty-five miles at an estimated approximately 4.7 miles per hour on Lake St. Clair, an about 100-hour total. This is reckoned to be more than the time that a small outboard is run in a boating season or year. The engine operates most effectively, and does not burn out during the testing.

CONCLUSION TO THE INVENTION

The present invention is thus provided. Various feature(s), part(s), subcombination(s) and/or combination(s) may be practiced with or without reference to other feature(s), part(s), subcombination(s) and/or combination(s) in the practice of the invention, and numerous and sundry adaptations and modifications can be effected within its spirit, the literal claim scope of which is particularly pointed out as follows:

What is claimed is:

1. A weed-trimmer outboard motor attachment comprising a lower shaft housing with a proximal coupling to correspondingly mate and engage a distal mid-shaft coupling of an upper part of a motorized weed-trimming device having a motor and a shaft that rotate a number of rotations per minute when operating; a distal termination thereto, which includes a propeller; and a rotation speed reduction unit, configured such that a number of rotations of the propeller in relation to the number of rotations of the motor of the motorized weed-trimming device is reduced, wherein:

the propeller is for rotating in water beneath an air-to-water surface of the water when operating:

the rotation speed reduction unit provides a motor to propeller (motor:propeller) rotation reduction ratio about from 3:1 to 15:1, and has a housing and gears and shafts, which include an input gear mounted on an input gear shaft, a cluster gear mounted on a cluster gear shaft, and an output gear mounted on an output gear shaft; and the weed-trimmer outboard motor attachment is configured to be able to be assembled to the distal mid-shaft coupling of the upper part of the motorized weed-trimming device to provide a weed-trimmer outboard motor useful for providing propulsion of a boat in the water and capable of being carried, held and controlled by hand.

2. The attachment of claim 1, wherein the motor:propeller ratio is about from 4:1 to 7:1.

3. The attachment of claim 1, wherein the motor:propeller ratio is 4.8:1 or thereabout.

4. The attachment of claim 1, wherein the motor of the motorized weed-trimming device is gasoline-powered and air-cooled, and has an accelerator control.

5. The attachment of claim 2, wherein the motor of the motorized weed-trimming device is gasoline-powered and air-cooled, and has an accelerator control.

6. The attachment of claim 3, wherein the motor of the motorized weed-trimming device is gasoline-powered and air-cooled, and has an accelerator control.

7. In combination, the attachment of claim 1, and assembled thereto the motorized weed-trimming device to provide the weed-trimmer outboard motor.

8. In combination, the attachment of claim 2, and assembled thereto the motorized weed-trimming device to provide the weed-trimmer outboard motor.

9. In combination, the attachment of claim 3, and assembled thereto the motorized weed-trimming device to provide the weed-trimmer outboard motor.

10. In combination, the attachment of claim 4, and assembled thereto the motorized weed-trimming device to provide the weed-trimmer outboard motor.

11. In combination, the attachment of claim 5, and assembled thereto the motorized weed-trimming device to provide the weed-trimmer outboard motor.

12. In combination, the attachment of claim 6, and assembled thereto the motorized weed-trimming device to provide the weed-trimmer outboard motor.

13. In combination, the attachment of claim 1, and assembled thereto the motorized weed-trimming device to provide the weed-trimmer outboard motor, and a mount for mounting to the weed-trimmer outboard motor such that the weed-trimmer outboard motor contains the mount.

14. The combination of claim 13, wherein the mount comprises a body having a throat to rest upon an upper surface of a transom of a boat to which the mount can be mounted, and fore and aft members depending from the throat; at least one transom-engaging fastener, which can engage the transom of the boat through one of the fore and aft members; a sleeve with an engaging flap that can be loosened and tightened, into which a shaft housing of the motorized weed-trimming device can be inserted; and at least one flap-securing fastener, which holds the shaft housing so that the outboard motor can be secured, yet rotatably swivel about the shaft housing.

15. In a screw attachment for a weed-trimmer, which comprises a lower shaft housing with a proximal coupling to correspondingly mate and engage a distal mid-shaft coupling of an upper part of a motorized weed-trimming device; and a distal termination with a propeller—such that when coupled, said attachment and the upper part of the motorized weed-trimmer can form a motorized weed-trimmer outboard motor for watercraft, and said attachment can be reversibly coupled to the upper part of the motorized weed-trimming device—wherein said attachment further includes a propeller core as part of a propeller-containing attachment, to which the propeller is attached, and within which is a transfer shaft having a transfer shaft receptacle for receiving and mating with a lower coupling to a flexible core wire in the lower shaft housing such that the transfer shaft and a distal portion of the flexible core wire with the lower coupling are mated in an in-line relationship; and a keel core for registering with the propeller core as well as receiving the lower shaft housing—the improvement which comprises a rotation speed reduction unit, configured such that a number of rotations of the propeller in relation to the number of rotations of the motor of the motorized weed-trimming device is reduced, wherein:

the propeller is for rotating in water beneath an air-to-water surface of the water when operating:

the rotation speed reduction unit provides a motor to propeller (motor:propeller) rotation reduction ratio about from 3:1 to 15:1, and has a housing and gears and shafts, which include an input gear mounted on input gear shaft, a cluster gear mounted on a cluster gear shaft, and an output gear mounted on an output gear shaft;

the motorized weed-trimming device has a gasoline-powered, air-cooled engine, with an accelerator control; and the weed-trimmer outboard motor attachment is configured to be able to be assembled to the distal mid-shaft coupling of the upper part of the motorized weed-trimming device to provide a weed-trimmer outboard motor useful for providing propulsion of a boat in the water and capable of being carried, held and controlled by hand.

16. The screw attachment of claim 15, wherein:

the engine of the motorized weed-trimming device has a gasoline-powered, is an 1800-RPM 1.0-HP engine; and the motor:propeller rotation reduction ratio is about from 4:1 to 7:1.

17. In combination, the screw attachment of claim 15, and assembled thereto the motorized weed-trimming device to provide the motorized weed-trimmer outboard motor.

18. In combination, the screw attachment of claim 16, and assembled thereto the motorized weed-trimming device to provide the motorized weed-trimmer outboard motor.

19. A weed-trimmer outboard motor attachment comprising a lower shaft housing with a proximal coupling to correspondingly mate and engage a distal mid-shaft coupling of an upper part of a motorized weed-trimming device having a motor and a shaft that rotate a number of rotations per minute when operating; a distal termination thereto, which includes a propeller; and a rotation speed reduction unit, configured such that a number of rotations of the propeller in relation to the number of rotations of the motor of the motorized weed-trimming device is reduced, wherein:

the motorized weed-trimming device has a gasoline-powered, 1800-RPM 1.0-HP 2-cycle, air-cooled engine, with an accelerator control;

the propeller is for rotating in water beneath an air-to-water surface of the water when operating;

the rotation speed reduction unit has an output shaft with a 21-tooth gear, an input shaft with a 14-tooth gear, a cluster gear including a 10-tooth smaller gear and a 32-tooth larger gear, bushings mounted in a housing, which includes an output side block, an input-side block, and a center plate; and the weed-trimmer outboard motor attachment has a curved lower shaft housing, and is configured to be able to be assembled to the distal mid-shaft coupling of the upper part of the motorized weed-trimming device to provide a weed-trimmer outboard motor useful for providing propulsion of a boat in the water and capable of being carried, held and controlled by hand.

20. In combination, the attachment of claim 19, and assembled thereto the motorized weed-trimming device to provide the weed-trimmer outboard motor.

* * * * *